US009790022B2

(12) United States Patent
Sheesley et al.

(10) Patent No.: US 9,790,022 B2
(45) Date of Patent: Oct. 17, 2017

(54) CONTAINER TO DELIVER BULK GRANULAR MATERIAL

(71) Applicant: SandCan, Inc., San Antonio, TX (US)

(72) Inventors: John M. Sheesley, San Antonio, TX (US); Clinton A. Plant, San Antonio, TX (US)

( * ) Notice: Subject to any disclaimer, the term of this patent is extended or adjusted under 35 U.S.C. 154(b) by 632 days.

(21) Appl. No.: 14/188,226

(22) Filed: Feb. 24, 2014

(65) Prior Publication Data

US 2014/0166647 A1 Jun. 19, 2014

Related U.S. Application Data

(63) Continuation-in-part of application No. 13/661,198, filed on Oct. 26, 2012, now abandoned, which is a continuation-in-part of application No. 13/370,401, filed on Feb. 10, 2012, now abandoned.

(51) Int. Cl.

| | |
|---|---|
| ***B65D 88/00*** | (2006.01) |
| ***B65D 88/30*** | (2006.01) |
| ***B65D 88/32*** | (2006.01) |
| ***B65D 90/58*** | (2006.01) |
| ***B65D 90/66*** | (2006.01) |

(52) U.S. Cl.

CPC ..... *B65D 88/30* (2013.01); *B65D 88/32* (2013.01); *B65D 90/587* (2013.01); *B65D 90/66* (2013.01); *B65D 2590/0091* (2013.01); *B65D 2590/664* (2013.01); *Y10T 29/49966* (2015.01)

(58) Field of Classification Search

CPC ..... B65D 88/30; B65D 90/66; B65D 88/32; B65D 90/587; B65D 2590/664; B65D 2590/0091; B65D 88/128; B65D 88/129; B65D 88/26; B65D 90/043; B65D 90/12; B65D 90/205; B65D 90/20; Y10T 29/49966; B65G 65/40

See application file for complete search history.

(56) References Cited

U.S. PATENT DOCUMENTS

| | | | | |
|---|---|---|---|---|
| 2,460,181 | A * | 1/1949 | Marshall | B32B 15/08 106/33 |
| 4,819,830 | A | 4/1989 | Schultz | |
| 4,944,421 | A | 7/1990 | Yurgevich | |
| 4,995,522 | A | 2/1991 | Barr | |
| 5,190,182 | A | 3/1993 | Copas et al. | |
| 6,012,598 | A | 1/2000 | Antoniou | |
| 6,105,805 | A | 8/2000 | Labelle et al. | |
| 6,328,183 | B1 † | 12/2001 | Coleman | |
| 6,401,983 | B1 | 6/2002 | McDonald et al. | |
| 6,527,134 | B2 † | 3/2003 | Hinkle | |
| 7,104,425 | B2 | 9/2006 | Le Roy | |
| 7,252,309 | B2 † | 8/2007 | Eng Soon et al. | |

(Continued)

*Primary Examiner* — Jun Yoo

(74) *Attorney, Agent, or Firm* — Gunn, Lee & Cave, P.C.

(57) ABSTRACT

A container is constructed to carry granular material from a quarry or source to the frac site. An open frame the size of a standard cargo container is constructed. An enclosed hopper is formed using flat sheet metal with bolted together perpendicular edges. The hopper is set within, and attached to, the frame. Top hatches provide for loading the hopper, and a lower sliding gate in a bottom opening provides for unloading the hopper. The bottom of the hopper is at an angle slightly above the angle of repose of the granular material carried therein.

4 Claims, 39 Drawing Sheets

(56) References Cited

U.S. PATENT DOCUMENTS

| | | | | |
|---|---|---|---|---|
| D688,349 | S | 8/2013 | Oren et al. | |
| D688,350 | S | 8/2013 | Oren et al. | |
| D688,351 | S | 8/2013 | Oren et al. | |
| D688,597 | S | 8/2013 | Oren | |
| D688,772 | S | 8/2013 | Oren et al. | |
| 8,505,780 | B2 | 8/2013 | Oren | |
| 8,545,148 | B2 | 10/2013 | Wanet-Pusset et al. | |
| D694,670 | S | 12/2013 | Oren | |
| 8,616,370 | B2 * | 12/2013 | Allegretti | B65D 19/06 108/51.11 |
| 8,622,251 | B2 | 1/2014 | Oren | |
| 8,668,430 | B2 | 3/2014 | Oren | |
| D703,582 | S | 4/2014 | Oren | |
| 8,820,559 | B2 † | 9/2014 | Beitler | |
| 2008/0226434 | A1 | 9/2008 | Smith | |
| 2009/0078410 | A1 | 3/2009 | Krenek et al. | |
| 2011/0127178 | A1 * | 6/2011 | Claussen | B65D 88/26 206/216 |
| 2013/0161211 | A1 | 6/2013 | Oren | |
| 2014/0020765 | A1 | 1/2014 | Oren | |
| 2014/0023463 | A1 | 1/2014 | Oren | |
| 2014/0023464 | A1 | 1/2014 | Oren | |
| 2014/0023465 | A1 | 1/2014 | Oren | |
| 2014/0083554 | A1 † | 3/2014 | Harris | |
| 2014/0305769 | A1 † | 10/2014 | Eiden, III | |

* cited by examiner
† cited by third party

CONTAINER TO DELIVER BULK GRANULAR MATERIAL

CROSS-REFERENCE

This is a continuation-in-part of U.S. patent application Ser. No. 13/661,198, which is a continuation-in-part of U.S. patent application Ser. No. 13/370,401 filed on Feb. 10, 2012, entitled "Method and Apparatus for Modifying a Cargo Container to Deliver Sand to a Frac Site", which parent application has one of the same inventors and the same assignee.

BACKGROUND OF THE INVENTION

1. Field of the Invention

This invention relates to the transportation of a granular substance such as sand and, more particularly, to containers for the purpose of transporting bulk granular substances.

2. Description of the Prior Art

Cargo containers (also called intermodal containers, freight containers, ISO containers, shipping containers, Hi-Cube containers, Sea Cans) are a standardized, reusable steel box used for the safe, efficient and secure storage and movement of materials and products within a global containerized freight transportation system. The container can be moved from one mode of transportation to another without unloading and reloading the contents of the container. All of the containers are 8 ft. wide so they can travel along standard highway systems. The height of the standard container is normally 8 ft. 6 in., but a "high cube" container of 9 ft. 6 in. in height can be used.

The part of the standard cargo container that may change is the length. The standard length is either 20 ft., 40 ft., 45 ft. or 53 ft.

A general purpose cargo container has doors fitted at one end and is constructed of corrugated weathering steel. The cargo containers can be stacked up to seven containers high. At each of the eight corners are castings with openings for twist-lock fasteners to hold the cargo containers in position. It is estimated there are 17 million cargo containers available world-wide.

In the railroad industry there is a category of shipping containers called "Container on a Flat Rack", which category does not require a terminal to load or unload.

In the last two years, hydraulic fracturing (also known as "fracing") has been used in hydrocarbon wells to create cracks in underground reservoir rock formations to create new channels in the rock, which increases the extraction rate and ultimate recovery of fossil fuels. To keep the fractures from closing, during the fracing process a proppant is injected with a fluid, which proppant keeps the fractures open once the pressure is released. The most common proppant used is sand, although in recent years other proppants such as resin-coated or ceramic sand has been utilized.

In reservoirs such as shale rock or coal beds, fracing may be used to cause the production of natural gas or oil from those formations. Otherwise, there is not sufficient viscosity, permeability or reservoir pressure to allow the natural gas or oil to flow from the rock into the well bore at economic rates. Fracturing will provide flow paths connecting a larger area of the reservoir to the well, thereby increasing the area from which natural gas or liquids can be recovered from a formation. In such case, a proppant, such as sand, is necessary to keep the fractures open with the oil and gas flowing there through.

In the fracturing of a single well, the amount of proppant such as sand that is used can cost five or six million dollars. Most of the cost of the sand is for handling. If the sand can be handled fewer times, the cost can be greatly reduced.

The type of sand used in fracing is also very critical. The sand should have high quartz content so that it will not crush in the cracks of the formation, but will hold the cracks open. The deeper the well, normally the more quartz content that is required. In order to get the appropriate types of sand, fracing companies have to purchase it throughout the world. For example, in deep wells in South Texas, the good quality fracing sand comes from such places as the States of Wisconsin and Illinois or countries such as China. From other countries, the sand is delivered to the United States by ship and is handled at multiple locations in multiple ways with very inefficient supply chain logistics for the handling of the fracing sand. The more times the fracing sand is handled, the more expensive it is to the individual fracing company and to the well operator. This is passed along to the consumer in the increased price of gasoline.

Also at the well site if a truck delivers sand and cannot unload when the truck arrives, then the operator is charged demurrage for waiting. It is common at many frac sites for a number of trucks to be waiting in line to be unloaded, for which the operator is being charged demurrage. It is important that as soon as the sand is delivered to the frac site, that it can be immediately unloaded to eliminate a demurrage charge.

The same containers that may deliver sand to a frac site may be used to deliver all types of granular material to a desired destination.

SUMMARY OF THE INVENTION

It is an object of the present invention to build containers for the delivery of granular material.

It is another object of the present invention to provide a frame for a container, which frame has a hopper to carry granular material therein.

It is still another object of the present invention to provide a frame of a container with a hopper therein where granular material can be inserted from the top and removed from the bottom of a totally self-contained unit.

It is another object of the present invention to provide containers that can carry sand all the way from the quarry to the ultimate destination of a fracing site without repeated handling of the sand.

A cargo container of 8 ft.×9 ft. 6 in.×20 ft. has a frame with an enclosed hopper therein to carry fracing sand. One or more hatches are provided in the top and one lower gate at the bottom of the hopper. The hopper is enclosed and located entirely within the frame of the cargo container. Upper hatches are located in the hole in the top of the hopper and are used to load sand in the cargo container. A lower gate is located in the hole in the bottom of the hopper and may be opened to remove the sand therefrom. Hydraulic controls may be used to open and close the upper hatches or lower gate.

The cargo container may be taken directly to the quarry and loaded with sand. The cargo container can then move through all of the normal modes of transportation including by ship, barge, rail, or truck, all the way to the frac site. The sand never has to be handled again. All that has to occur is the cargo container is moved from one mode of transportation to another (i.e., ship-to-rail-to-truck) as it moves from the quarry to the frac site.

Also, the containers may be stacked in any conventional means, either while in transit or at the frac site. This eliminates the demurrage of waiting to unload sand into bulk sand containers at the frac site.

In an alternative design of the present invention, a cargo container does not have to be used as a starting point. A frame can be built that is the same size as a standard cargo container. Then, within the frame, a hopper may be nestled inside of the frame. The hopper can be constructed of any of a number of methods including welding, molding or the bolting together of panels. All that is necessary is that the hopper have a hatch for loading through the top and a lower discharge gate at the bottom of the funnel-shaped hopper for unloading.

If the container is going to travel over the roadways, it is necessary that the truck and trailer not exceed 80,000 pounds. If a device such as a rough terrain cargo handler (RTCH) is being used to load and unload the container, the RTCH can handle up to 56,000 pounds. The hopper is disposed to handle up to 60,000 pounds.

If the hopper of the container is made from sheets of metal, the sheets can be folded on each edge thereof and the folded edges bolted together to form the hopper. The hopper, once assembled, can then be lowered into a frame that is designed and constructed to be the same size as a standard cargo container. The hopper is nestled into position inside of the frame and attached thereto. Sliding gates can be used to open and close the lower discharge gate for the hopper. Upper hatches can be used to fill the hopper, which upper hatches can be sliding or flip open type.

To prevent leaks between individual panels, a sealant material is inserted between the bolted-together folded edges of each panel.

DESCRIPTION OF THE PREFERRED EMBODIMENT

Figure 1:
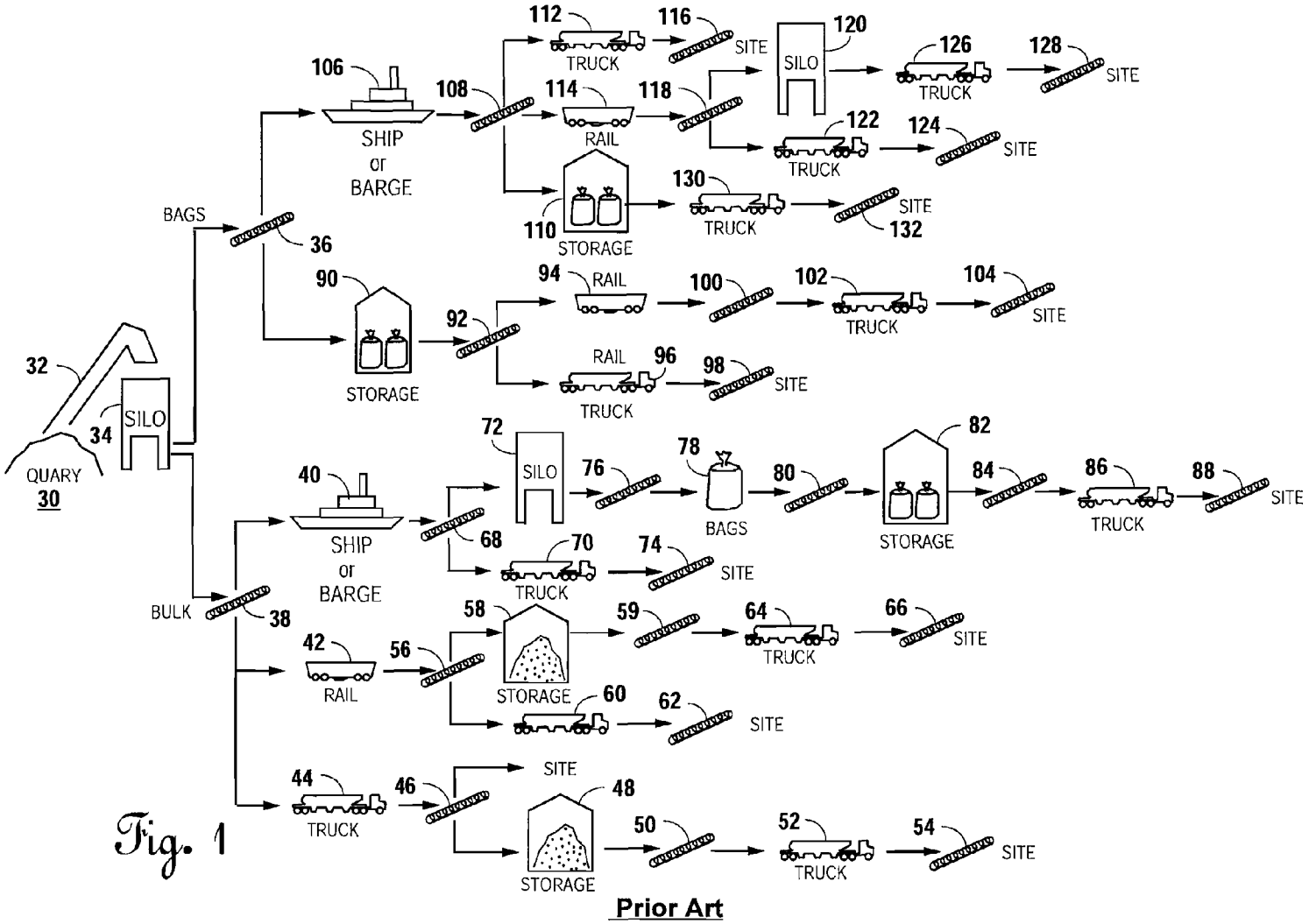
Prior Art Fig. 1
FIG. 1 is a pictorial illustration of all the ways sand is delivered from the quarry to the frac site.

Referring first to FIG. 1, fracing sand may be produced in a quarry 30, which sand is loaded to an elevator 32 into a sand silo 34. From the sand silo 34, sand may be loaded by conveyer 36 into bags or is left in bulk by conveyer 38 into a ship or barge 40, rail car 42, or truck 44.

Referring first to the truck 44, the truck 44 may be unloaded by conveyer 46 at the site or at the storage 48. While shown as conveyer 46, any other type of unloading/loading device can be used, such as a pneumatic pump. From storage 48, the sand may be reloaded by conveyer 50 onto truck 52 for unloading by conveyer 54 at the site.

If the fracing sand comes by rail car 42, rail car 42 may be unloaded by conveyer 56 into storage 58 or truck 60. If loaded into truck 60, then the sand would be unloaded by conveyer 62 at the frac site. If the sand goes through storage 58, it will later have to be loaded by conveyer 59 onto trucks 64 and then unloaded at the frac site by conveyer 66.

If the fracing sand comes by ship or barge 40, the ship or barge 40 will be unloaded by conveyer 68 into truck 70 or sand silo 72. If loaded into truck 70, the sand can be taken to the frac site and unloaded by conveyer 74. For sand traveling by ship or barge 40 that is placed in sand silo 72, sand from the sand silo 72 may be loaded through conveyer 76 into bags 78, which bags are moved by conveyer 80 into storage 82. From storage 82 bags 78 will subsequently be opened and loaded through conveyer 84 onto sand truck 86 for delivery to the site and unloaded by conveyer 88.

Bags from conveyer 36 may be located in storage 90. From the storage 90, the bags may be emptied onto conveyor 92 and loaded onto either rail car 94 or truck 96. If loaded onto truck 96, then the sand will be unloaded on conveyor 98 at the frac site. If the sand is loaded onto rail car 94, it must later be transferred via conveyer 100 onto truck 102 prior to unloading by conveyer 104 at the frac site.

Also, the bags of sand from conveyer 36 can be loaded on ship or barge 106. From the side of the ship or barge 106, the sand may either be unloaded from the bags or left in the bags. If left in the bags, then bags of sand would be unloaded by conveyer 108 into storage 110. If unloaded from the bags, the sand then would be loaded by the conveyer 108 into either truck 112 or rail car 114. If loaded on truck 112, the sand will be taken and unloaded at the frac site by conveyer 116. If unloaded into rail car 114, sand will be unloaded by conveyer 118 into either sand silo 120 or truck 122. If unloaded into truck 122, then it could be taken to the frac site and unloaded by conveyer 124. If unloaded into the sand silo 120, sand must subsequently be loaded into truck 126 and can be moved to the frac site and unloaded by conveyer 128.

If the sand was put into sand storage 110, the bags then must be opened and emptied into truck 130, taken to the frac site and unloaded by conveyer 132.

As can be seen from FIG. 1, there are numerous different ways of moving the sand from the quarry 30 or manufacturing site to the various frac sites. Each time the sand has to be handled through a conveyer, it is an additional expense. Each additional expense means that sand costs more money for the well operator, which goes into additional costs of producing oil, which flows on to the end consumer through higher prices of gasoline, diesel fuel, or natural gas.

Figure 9:
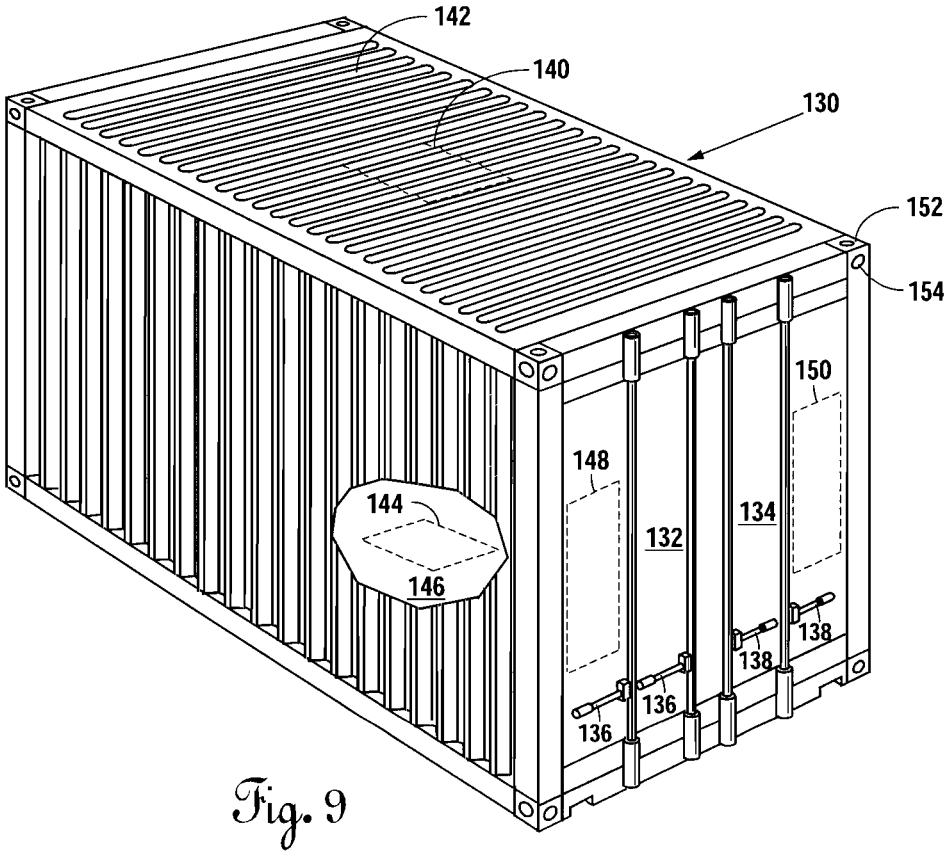
FIG. 9 is a pictorial view of a cargo container illustrating where openings should be cut.

Referring now to FIG. 9, a standard 8 ft.×8½ ft.×9½ ft.×20 ft. cargo container 130 is shown. The cargo container 130 is made out of corrugated metal and has doors 132 and 134, on the one end thereof, which doors 132 and 134 are operable by handles 136 and 138, respectively. Top hole 140 is cut into the top 142 of the cargo container 130. Bottom hole 144 is cut into bottom 146 of the cargo container 130. Control panel openings 148 and 150 are cut in doors 132 and 134, respectively. The cargo container 130 as illustrated in FIG. 9 has eight corner castings 152 with openings 154 for twist-lock fasteners (not shown).

Figure 10:
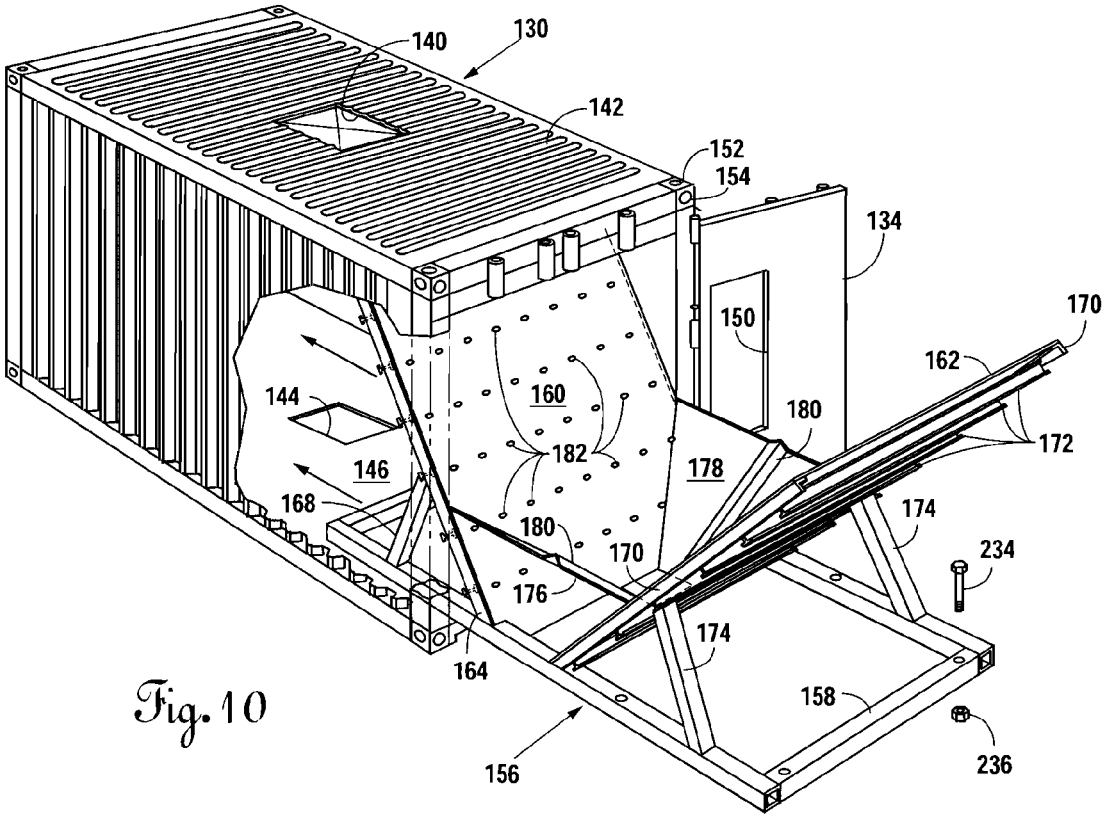
FIG. 10 is the cargo container shown in FIG. 9 with the holes cut and a hopper module being inserted therein.

Referring now to FIG. 10, modification of the cargo container 130 is shown. The top hole 140 and bottom hole 144 have been cut as well as the control panel openings 148 and 150. The control panel opening 150 is illustrated because door 132 has been removed so the hopper module 156 can be seen as it is being inserted inside of cargo container 130. Alternatively, the hopper module 156 may be constructed inside of the cargo container 130.

Figure 12:
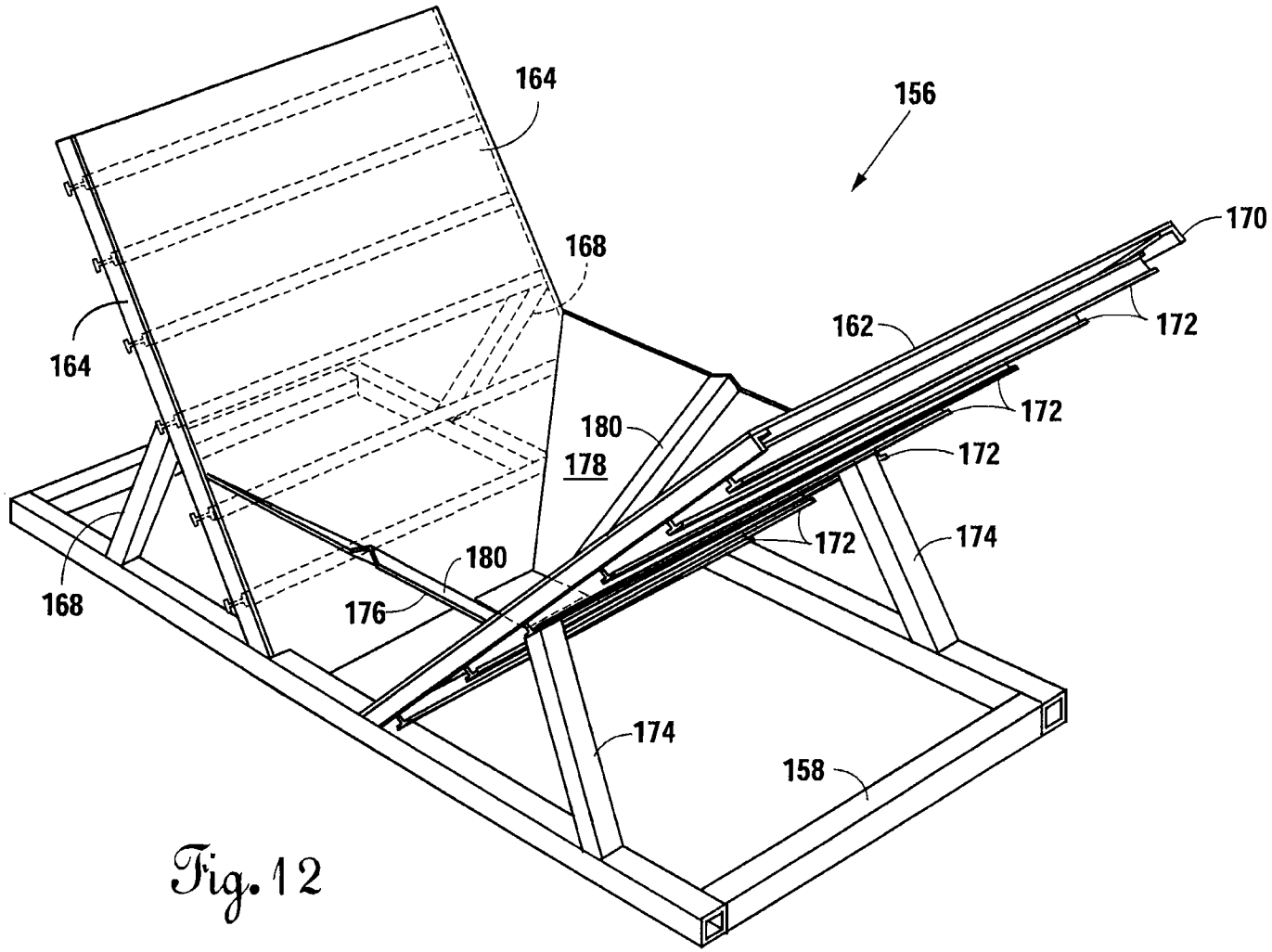
FIG. 12 is a perspective view of the hopper module to be inserted in the cargo container of FIG. 10.

Referring now to FIGS. 10 and 12, the hopper module 156 will be explained in more detail. Hopper module 156 has a width so that it will fit just inside of the fully opened doors 132 and 134. Hopper module 156 has a base 158 made out of tubular steel. Towards the front of the base 158 is front module wall 160 and towards the rear is rear module wall 162. Behind the front module wall 160 are L-beams 164 with I-beams 166 providing cross support there between. To hold the front module wall at or near the angle of repose, sand or similar granular material, front braces 168 are located between the L-beams 164 and the base 158.

Just as the front module wall 160 is supported, rear module wall 162 is also supported by L-beams 170 and I-beams 172. The rear module wall 162 is held at or near the angle of repose by rear braces 174, extending between L-beams 170 and base 158.

On each side of the hopper module 156 is located left side wall 176 and right side wall 178. Both the left side wall 176 and the right side wall 178 have a ridge 180 formed therein to give additional strength to either the left side wall 176 or the right side wall 178.

As can be seen in FIG. 10, the front module wall 160 has numerous weld spots 182 therein, which is where the front module wall 160 is electrically welded to the I-beams 166 located there behind. The weld spots are only illustrated in FIG. 10. The hopper module 156 is wide enough so that it barely fits inside of cargo container 130.

Figure 11:
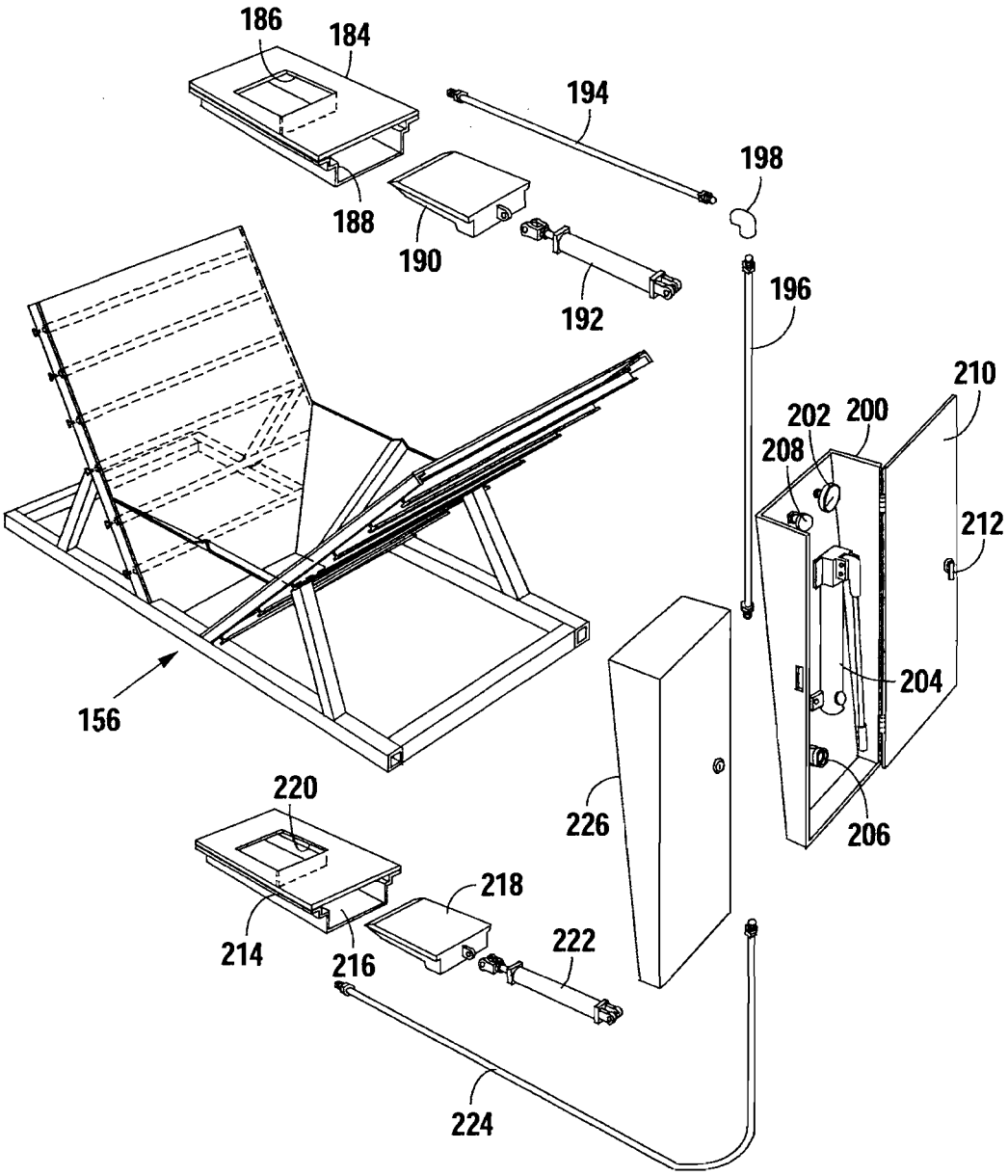
FIG. 11 is an exploded perspective view of the equipment that needs to be added to the cargo container illustrated in FIGS. 9 and 10.

The component parts needed to retrofit the cargo container 130 are illustrated in the exploded perspective view of FIG. 11. The hopper module 156 has already been explained in conjunction with FIGS. 10 and 12. At the top hole 140 (see FIG. 10) is located at upper hatch 184, which upper hatch 184 has an upper opening 185 therein. Upper hatch 184 has a wedge-shaped slot 188 there below with an upper sliding door 190 (as will be explained in more detail subsequently) that slides back and forth into wedge-shaped slot 188 to open and close the upper opening 186 in the upper hatch 184. An upper hydraulic cylinder 192 moves the upper sliding door 190 from the open to closed position and vice versa. Hydraulic lines 194 and 196 connect via elbow 198 to upper hydraulic control panel 200 inside of the upper hydraulic control panel 200. The hydraulic lines connect via pressure gauge 202 to either a hand-operated hydraulic pump 204 or a remote hydraulic connection 206. If hydraulic pressure needs to be relieved from the upper hydraulic cylinder 192, the pressure may be relieved by pressure relief valve 208. The upper hydraulic control panel 200 may be closed and locked by closing the upper hydraulic panel control door 210 and locked by turning the lock 212.

The bottom hole 144 (see FIG. 10) is operated the same way with a lower hatch 214 having a wedge-shaped slot 216 therein in which the lower sliding door 218 opens and closes the lower hatch 220, operation of the lower sliding door 218 being controlled by lower hydraulic cylinder 222. The lower hydraulic cylinder 222 is connected by hydraulic line 224 to the lower hydraulic control panel 226. The lower hydraulic control panel 226 works in the same manner as the upper hydraulic control panel 200. Therefore, the internal workings will not be explained again.

Figure 13:
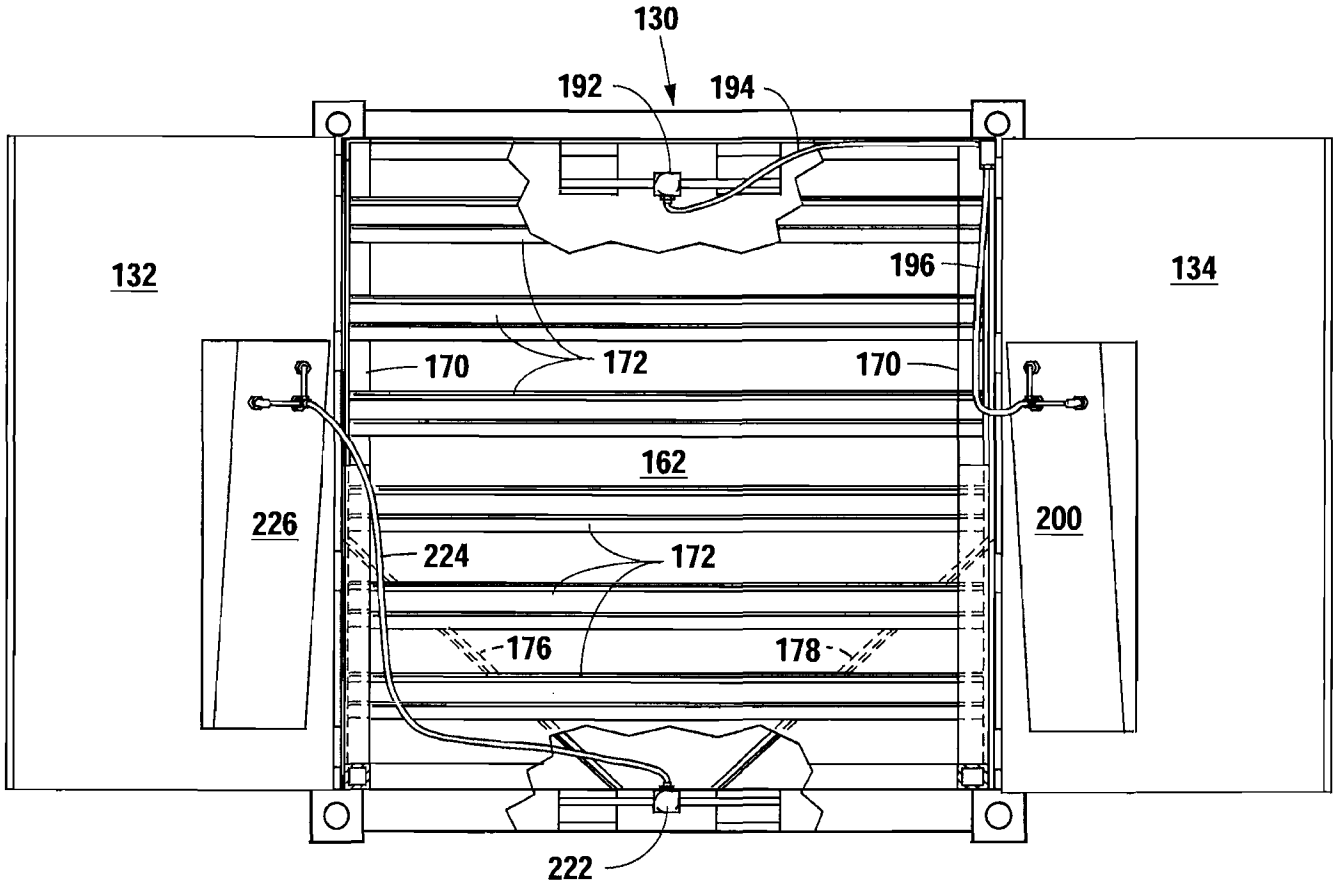
FIG. 13 is an elevated end view of a modified cargo container with the end doors opened.
Figure 14:
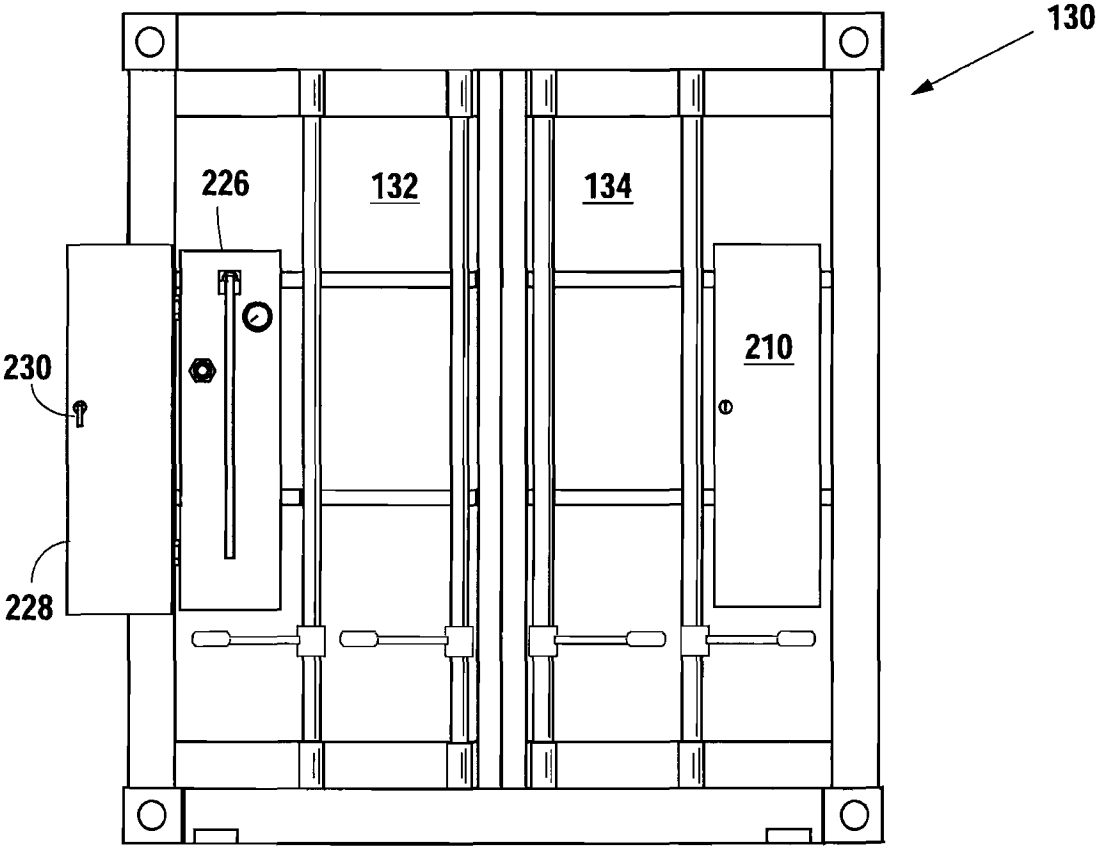
FIG. 14 is an end view of a modified cargo container illustrating the control panels.

Referring to FIGS. 13 and 14 in combination, the elevated end view of a modified cargo container 130 is shown, first with the doors 132 and 134 being opened in FIG. 13, then closed in FIG. 14. Referring first to door 132, lower hydraulic control panel 126 is shown. The hydraulic line 224 connects to the lower hydraulic cylinder 222 to open the lower hatch (not shown in FIG. 13).

On the other door 134 is located upper hydraulic control panel 200 which connects through hydraulic lines 196 and 194 to upper hydraulic cylinder 192 to open the upper hatch (not shown in FIG. 13).

The end of rear module wall 162 can be seen along with the L-beams 170 and the I-beams 172. Likewise, the left and right side walls 176 and 178, respectively, can be seen in broken lines.

Referring to FIG. 14, doors 132 and 134 are closed with the lower hydraulic control panel 126 being opened and the upper hydraulic control panel 210 being closed. The door 228 of the lower hydraulic control panel 226 can be closed and locked via lock 230.

Figure 15:
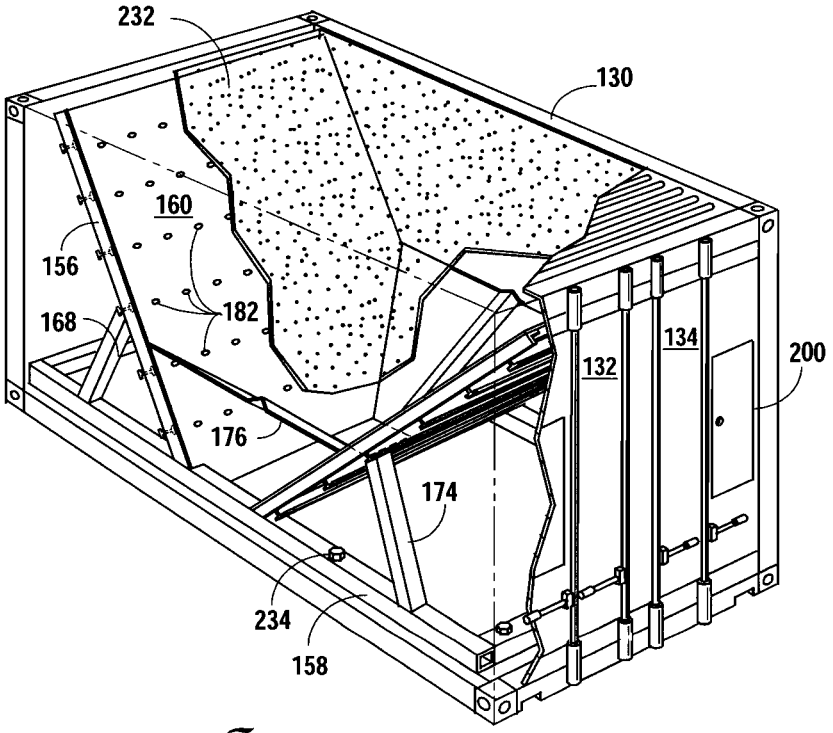
FIG. 15 is a partial sectional view of a modified cargo container.

Referring now to FIG. 15, a partial exploded view of the cargo container 130 having a hopper module 156 therein is shown. The inside of the hopper module 156 is covered with a liner material 232. The types of the liner material 232 may vary, but the type that is found to work well by Applicant is a "Greased Lightning Liner" made by RRR Supply, Inc. The inside of the cargo container 130, and more particularly, the inside of the hopper module 156, are coated with the liner material 232, which liner material 232 is very slick. This greatly reduces the angle of repose (the angle at which the granular material will flow) inside of cargo container 130.

Referring to FIGS. 10 and 15, the hopper module 156 is held into position by bolts 234 connecting through the bottom 146 of the cargo container 130 to nut 236. While only one bolt 234 and nut 236 are illustrated, several would be used.

Figure 16:
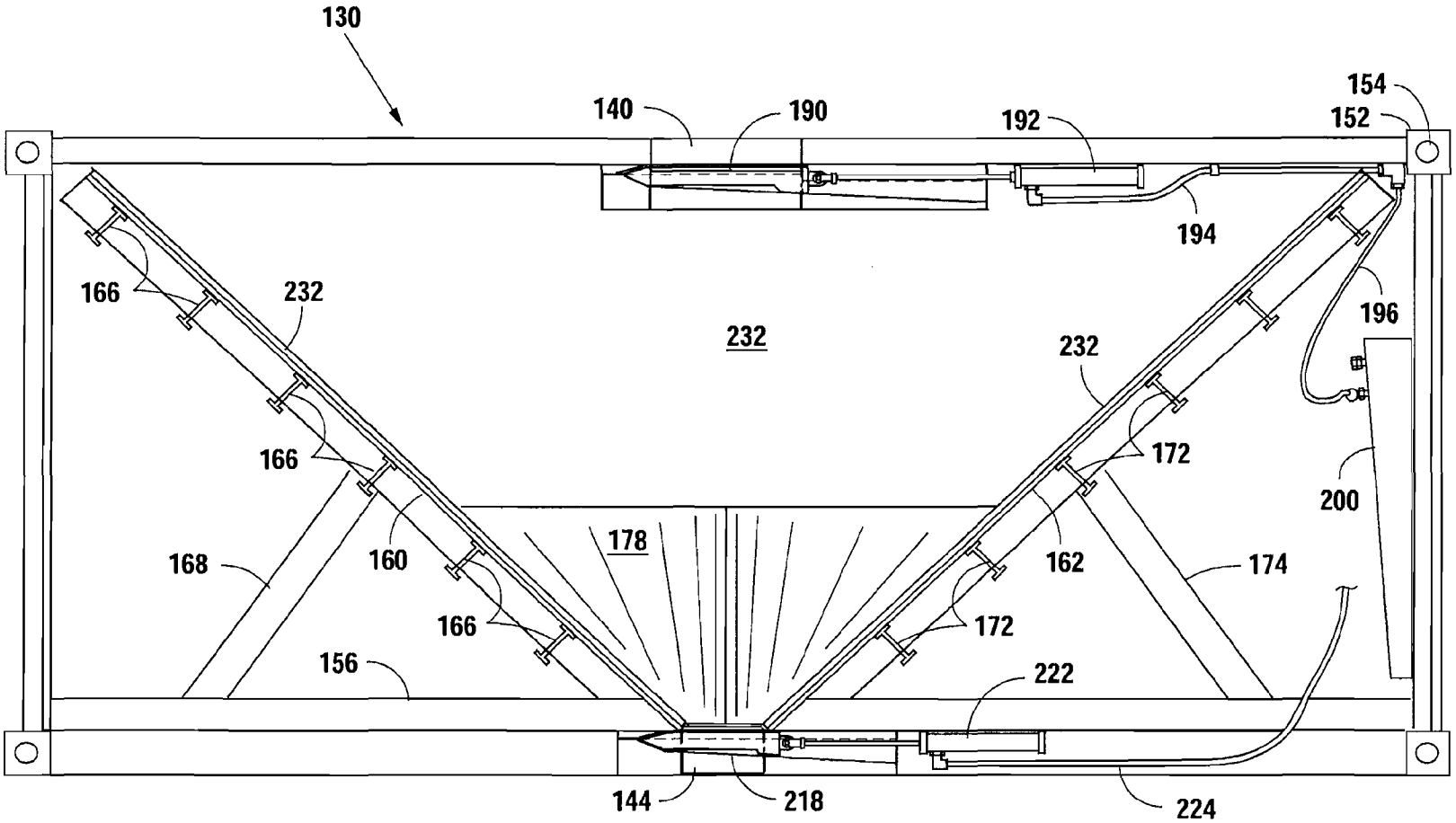
FIG. 16 is an elevated sectional view of one side of the modified cargo container illustrating the upper and lower hatches being closed.
Figure 17:
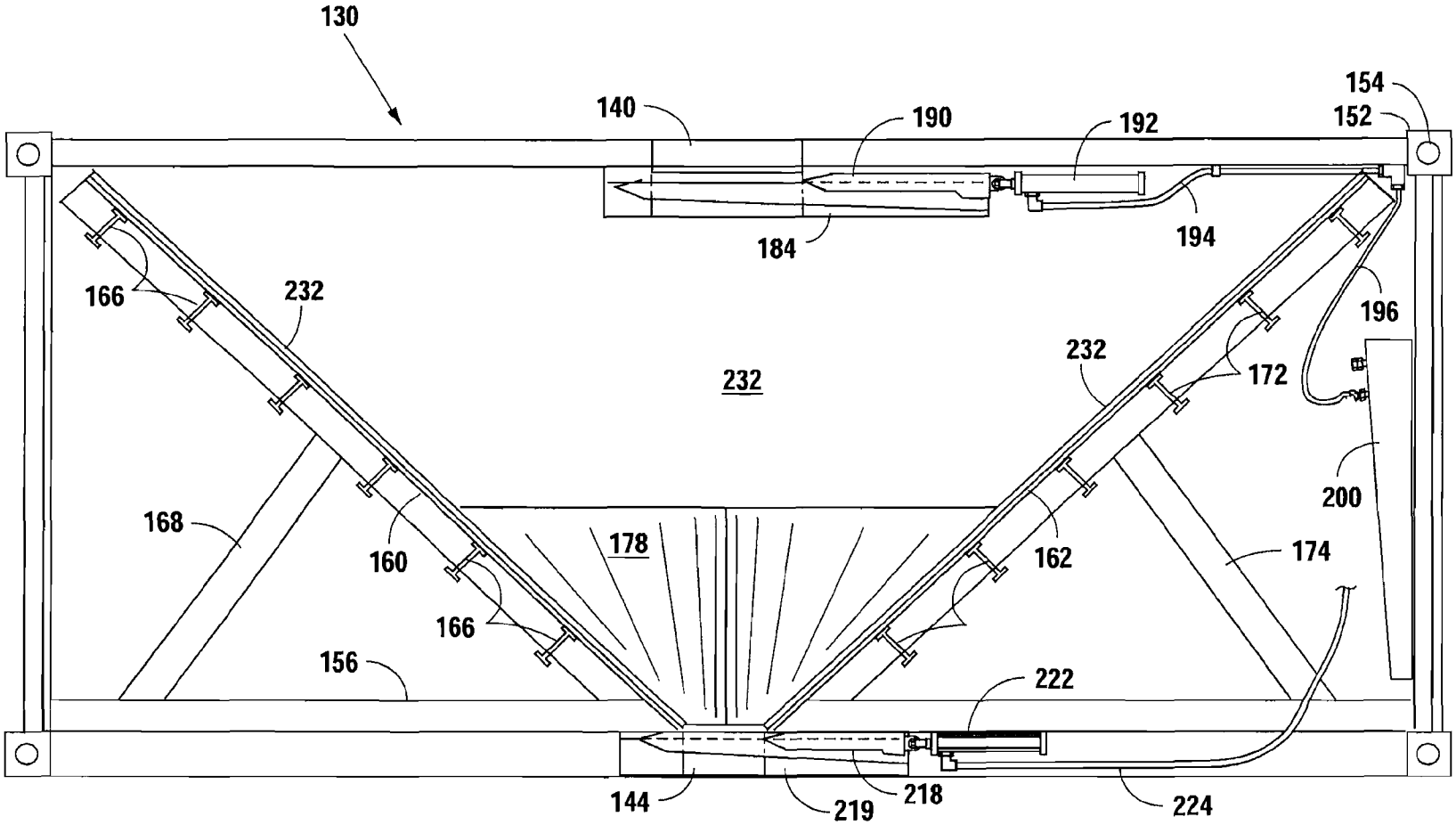
FIG. 17 is an elevated sectional view of one side of the modified cargo container illustrating the hatches being opened.

Referring to FIGS. 16 and 17, the operation of the upper hatch 184 and lower hatch 220 is explained in detail. The top hole 140 and the bottom hole 144 can be seen in both FIGS. 16 and 17. However, in FIG. 17, upper hatch 184 is opened because upper sliding door 190 is retracted by upper hydraulic cylinder 192. Also in FIG. 17, bottom hole 144 is open because lower hatch 214 has lower sliding door 218 retracted by lower hydraulic cylinder 222. The lower hydraulic cylinder 222 connects through hydraulic line 224 to the lower hydraulic control panel 226 (not shown in FIGS. 16 and 17). The upper hydraulic cylinder 192 will connect through hydraulic lines 194 and 196 to upper hydraulic control panel 200.

FIG. 16 is the same as FIG. 17, except the upper sliding door 190 and lower sliding door 218 are both closed. This occurs via upper hydraulic cylinder 192 and lower hydraulic cylinder 222, respectively. Otherwise, everything is the same.

Figure 18:
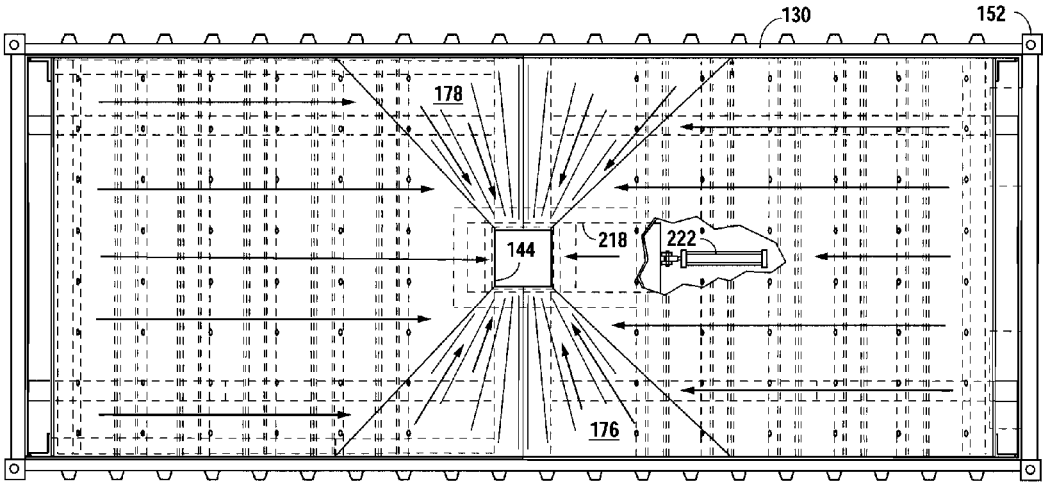
FIG. 18 is a top sectional view of the modified cargo container illustrating flow of the sand therefrom.

Referring now to FIG. 18, a top view of the cargo container 130 as modified is shown, but with the top 142 removed. The lower hydraulic cylinder 222 has moved the lower sliding door 218 so that the bottom hole 144 is now open. Any sand or granular material contained inside of modified cargo container 130 flows down towards the bottom hole 144 in the direction indicated by the arrows.

If there is any space between left side wall 176 and right side wall 178, it is filled in with a spray on material sold under the mark LINE-X. The LINE-X makes sure there is no space between the Greased Lightning sheets of material and the edges. The inside of the modified cargo container 130 will have a slick container hopper area.

Figure 19:
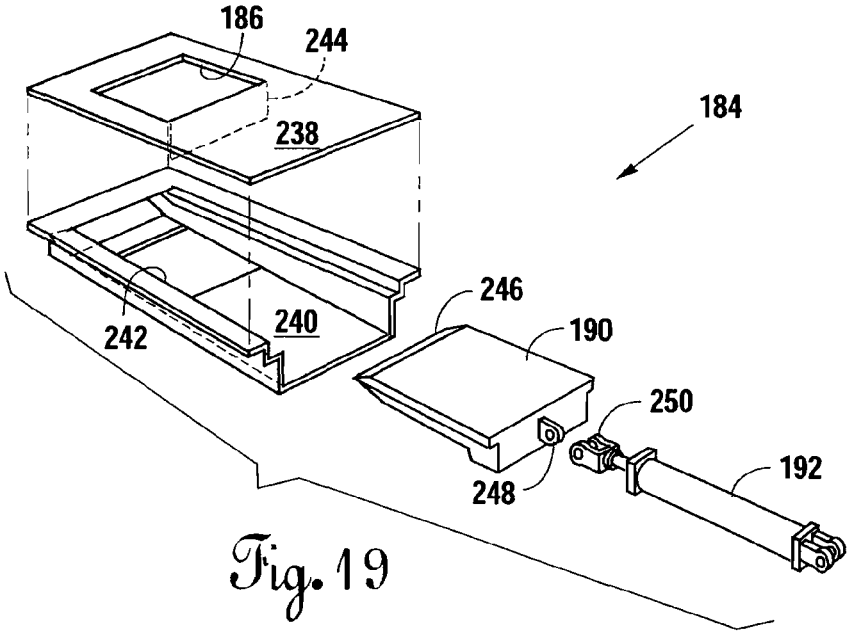
FIG. 19 is an exploded perspective view of a sliding door used at an upper or lower hatch.
Figure 20A:
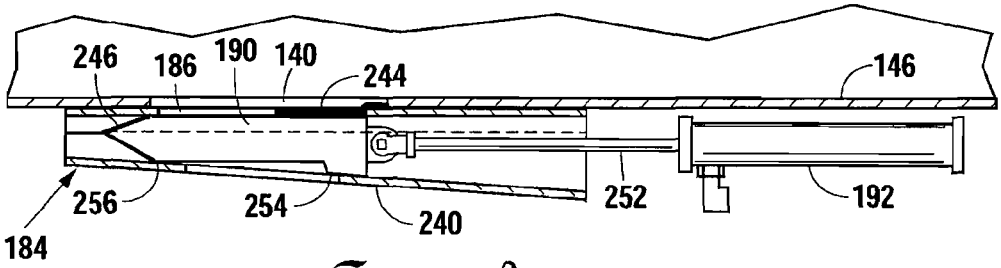
FIG. 20A is a cross-sectional view of a sliding door for a hatch being closed.
Figure 20B:
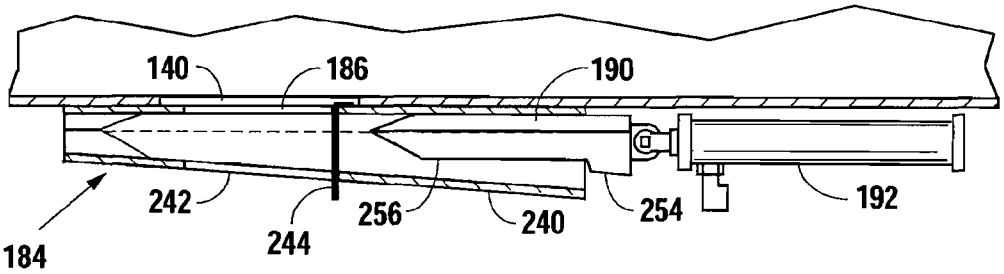
FIG. 20B is a cross-sectional view of a sliding door at a hatch being opened.

Referring now to FIGS. 19, 20A and 20B in combination, the operation of either the upper hatch 184 or lower hatch 214 is illustrated. For the purposes of consistency and numbers, FIGS. 19, 20A and 20B are being explained as operation of the upper hatch 184. The upper hatch 184 has a top plate 238 through which the upper opening 186 is cut. The top plate 238 connects to a wedge-shaped trough 240. The wedge-shaped trough 240, in combination with the top plate 238, makes up the upper hatch 184. The wedge-shaped trough 240 has a lower opening 242 therein. A resilient flap 244 made from a flexible material such as rubber hangs down from top plate 238 as is illustrated in FIG. 19.

The upper sliding door 190 has a wedge-shape front end 246 and a pivot point 248 on the rear thereof for connection to the clevis 250 on the front of the upper hydraulic cylinder 192.

In FIG. 20A, the upper hatch 184 is shown in a closed position. The upper sliding door 190 is moved all the way forward by the piston rod 252 of the upper hydraulic cylinder 192. The wedge shape 246 on the front of the upper sliding door 190 moves the resilient flap 244 upward and out of the way. The wedge-shaped trough 240 presses against the bottom shoulder 254 of the sliding door 190. Likewise, the front part of the wedge-shaped trough 240 presses against the front lower edge 256 of upper sliding door 190. The upward force on the bottom shoulder 254 and the front lower edge 256 by the wedges-shaped trough 240 causes a complete sealing of the top hole 140 and the upper opening 186 in the upper hatch 184.

Referring now to FIG. 20B, the upper sliding door 190 has been retracted by the upper hydraulic cylinder 192 so that now the top hole 140 and the upper opening 186 in hatch 184 are open and in alignment with lower opening 242 so that any sand there above will flow there through. The resilient flap 244 drops down as illustrated in FIG. 20B. The upper hydraulic cylinder 192 (or any other hydraulic cylinders) may be replaced with pneumatic, electrical or mechanical operators.

The lower hatch 214 operates in the same manner as the upper hatch 184 as previously described in conjunction with FIGS. 19, 20A and 20B.

Figure 21A:
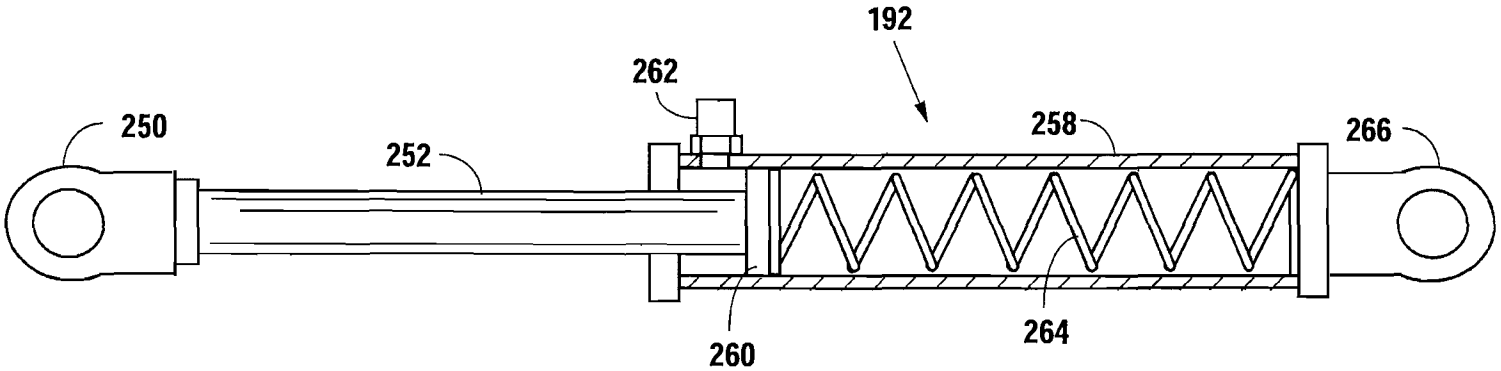
FIGS. 21A and 21B illustrate a spring-loaded cylinder being used to open or close a hatch.
Figure 21B:
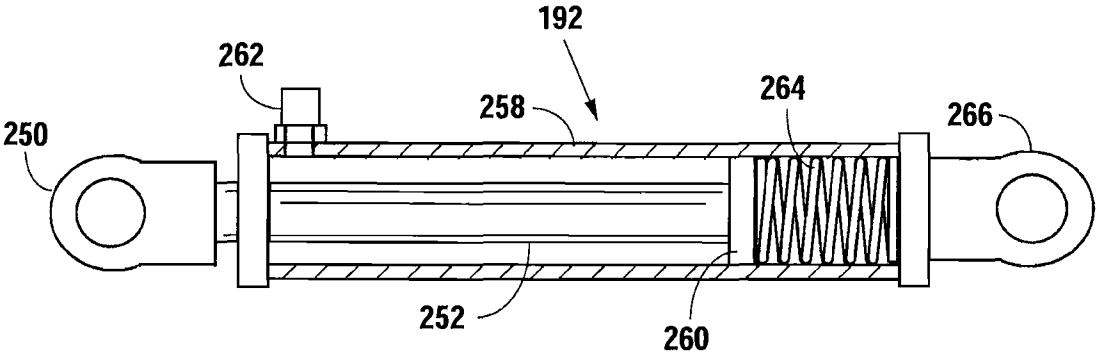

Operation of the upper hydraulic cylinder 192 is explained in conjunction with FIGS. 21A and 21B. The upper hydraulic cylinder 192 has a cylinder 258 with a piston 260 located in one end thereof. Typically, pressure is applied to the piston 260 through pressure connection 262. In the unpressurized state, spring 264 forces piston 260 out, which in turn pushes piston rod 252 with the clevis 250 outward, which in turn will close upper sliding door 190 as shown in FIG. 20A. The upper hydraulic cylinder 192 is held in position by pivot connection 266.

Alternatively, hydraulic pressure may be used to extend and retract the upper hydraulic cylinder 192 or lower hydraulic cylinder 222.

When pressure is applied to the upper hydraulic cylinder 192 as previously explained in FIG. 21A, the piston 260 is moved in the opposite direction and the spring 264 compressed. This causes the piston rod 252 to be refracted inside of cylinder 258. As long as pressure is applied through pressure connection 262, spring 264 will remain compressed and the upper sliding door 190 refracted as shown in FIG. 20B.

Figure 22:
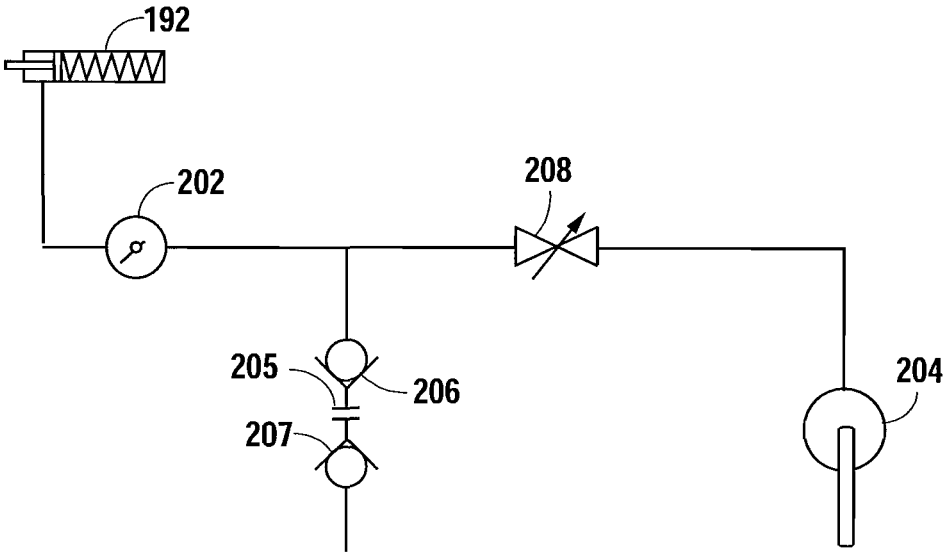
FIG. 22 is a schematic illustration of the opening and closing of hatches for a modified cargo container.

The sequence of operation is explained in the schematic of FIG. 22, which is for opening the upper hatch 184, but can equally apply to lower hatch 214. Upper hydraulic cylinder 192 can receive pressurized hydraulic fluid from either hand-operated hydraulic pump 204 or remote hydraulic connection 206. Remote hydraulic connection 206 may connect through hydraulic plug 205 to a remote hydraulic fluid source 207. Pressure gauge 202 monitors pressure being delivered to upper hydraulic cylinder 192. Pressure relief valve 208 may relieve the pressure if excessive, or to return upper hydraulic cylinder 192 to its normally extended position, i.e., hatch 184 closed.

The various supply chains and the numerous handling of sand was explained in conjunction with FIG. 1. The supply chain can be greatly reduced by use of a modified cargo container 130 as previously described in conjunction with FIGS. 9 through 22.

Figure 2:
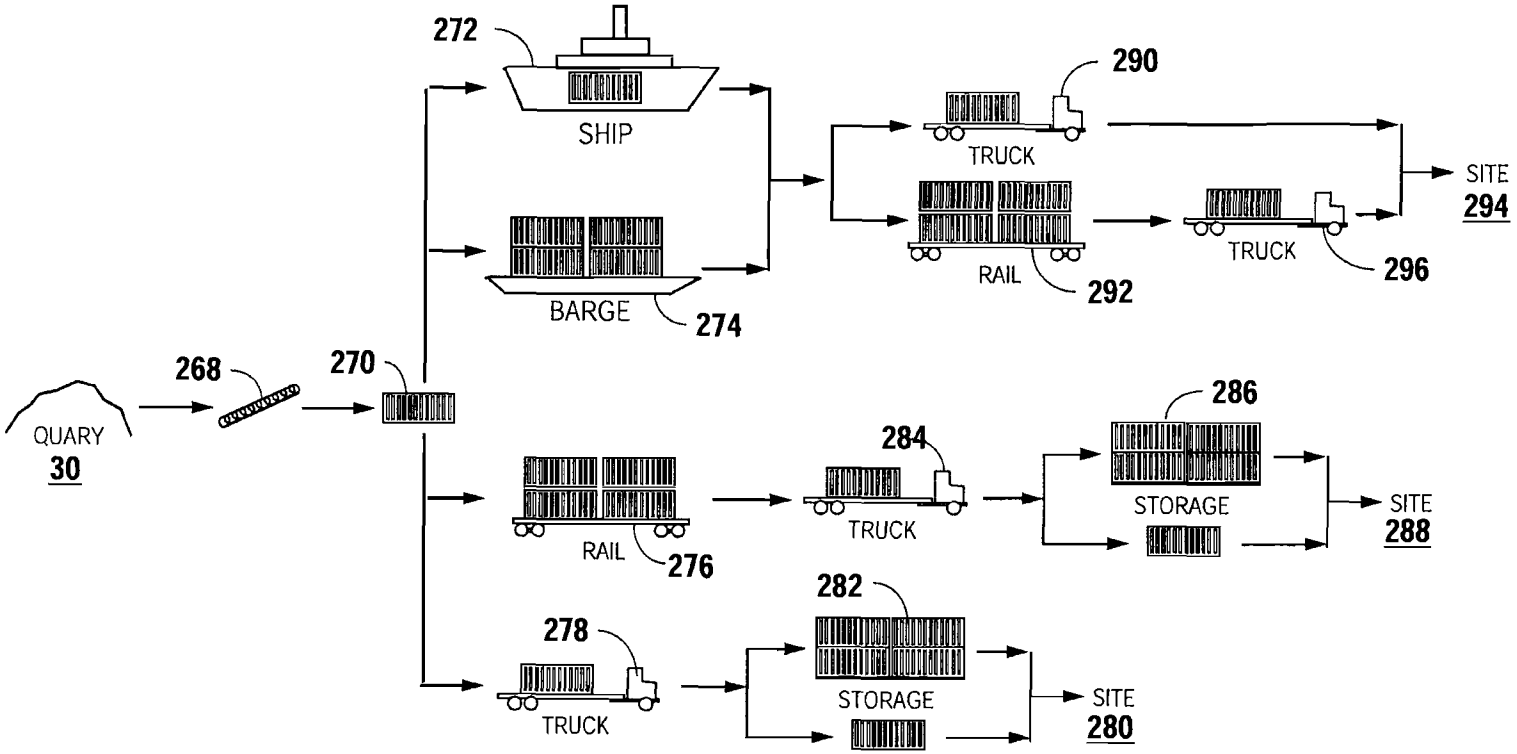
FIG. 2 illustrates the present invention being used to deliver sand from the quarry or source to the frac site.

Turning to FIG. 2, sand from the sand quarry 30 or source can now be loaded by a conveyer 268 to a modified cargo container which hereinafter will be referred to by reference numeral 270. Modified cargo containers 270 can be loaded on a ship 272, barge 274, rail 276 or a flatbed truck trailer 278. Obviously, multiple modified cargo containers 270 may be loaded on each of these alternative modes of transportation.

If the modified cargo containers 270 are loaded on flatbed truck trailer 278 or container chassis, the modified cargo containers 270 can be taken directly to the fracing site 280 or placed in storage 282 at the fracing site 280.

Concerning sand being hauled by rail 276, the modified cargo containers 270 will have to be off-loaded onto flatbed truck trailer 284, which flatbed truck trailer 284 can then take the modified cargo containers 270 filled with fracing sand either to storage 286 or to the fracing site 288.

Concerning the modified cargo containers 270 being hauled by ship 272 or barge 274, the modified cargo containers 270 will have to be off-loaded onto either a flatbed truck trailer 290 or a rail car 292. If being hauled by the flatbed truck trailer 290, the modified cargo container 270 can be taken directly to the fracing site 294. However, if modified cargo containers 270 are being transported by rail car 292, they must be off-loaded onto flatbed truck trailer 296 prior to be taken to the fracing site 294.

By just comparing FIGS. 1 and 2, it can be easily seen that the sand is being handled fewer times by the use of the modified cargo container 270. This results in considerably less expense, which reduces the price of fracing sand or other proppants to the well operator. The reduction in price can be in the millions of dollars per well.

Figure 3:
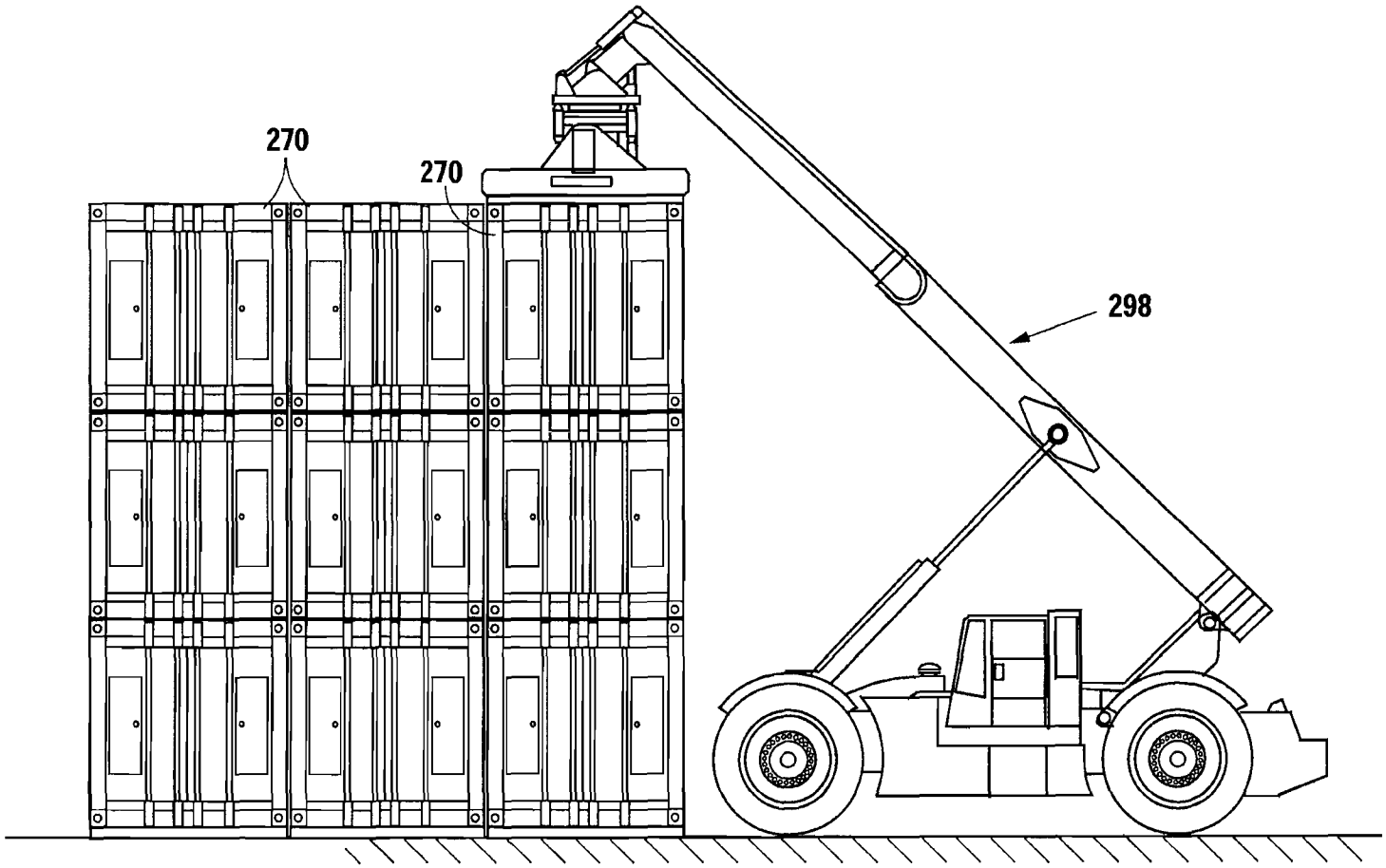
FIG. 3 is a pictorial illustration of the stackability of modified cargo containers, with or without sand therein.
Figure 4:
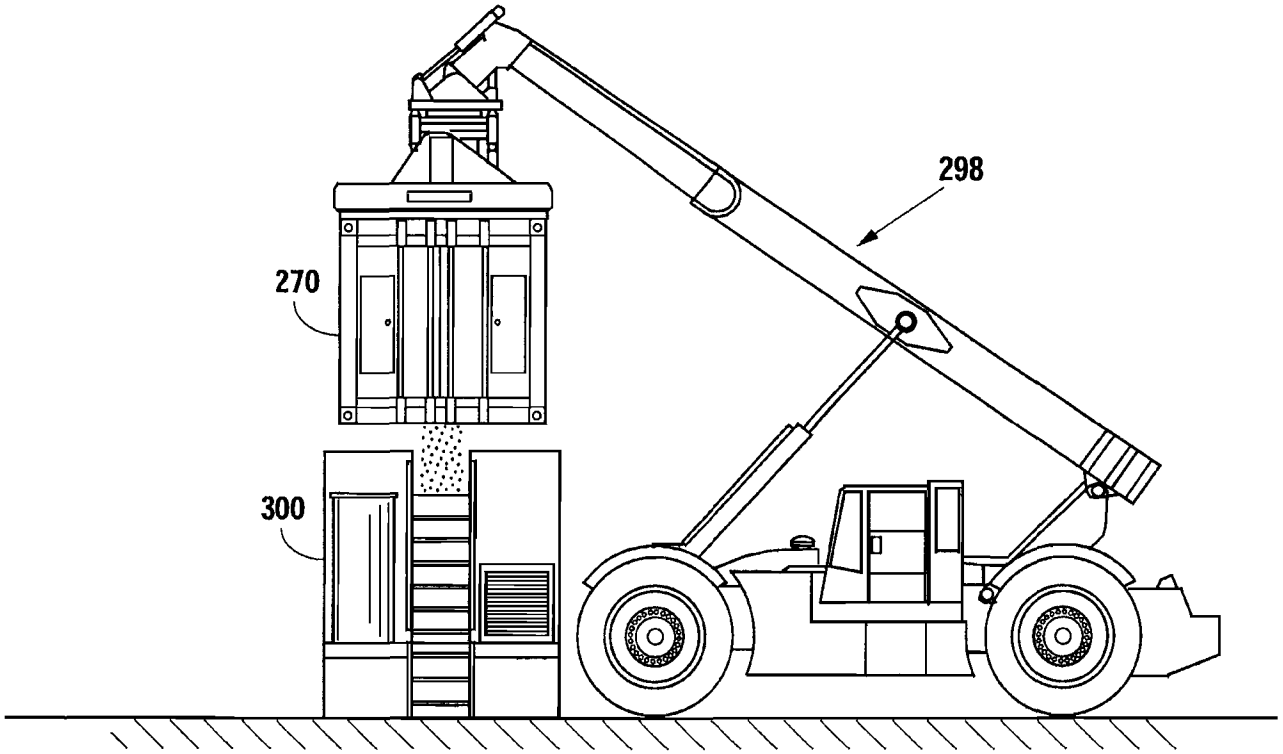
FIG. 4 is an illustration showing sand being unloaded from a modified cargo container at the frac site with the use of a RTCH into a bulk sand container.

At the well site to be fraced, modified cargo containers 270 can be stacked as shown in FIG. 3. Since well sites have a tendency to be rough, the Rough Terrain Container Handler (RTCH) as made by Kalmar from Cibolo, Tex. may be used to pick up and stack the modified cargo containers 270 as illustrated in FIG. 3. The modified cargo containers 270 may be stacked up to seven containers high for approximately 243,000 lbs. total weight. The Rough Terrain Cargo Handler 298 can pick up one of the modified cargo containers 270 full of sand and unload the modified cargo container 270 to a bulk sand container 300 at the frac site (see FIG. 4). The bulk sand container 300 may be the Frac Sander as is made by NOV-APPCO, located at 492 N. W.W. White Road, San Antonio, Tex. 78219. From the Sand King 300, sand travels on a conveyer in the bottom thereof to the blender (not shown) at the frac site.

Also, one modified cargo container, while stacked, can feed directly into another modified cargo container located there below. For example, in FIG. 5, modified cargo container 302 receives sand 306 from auger 303 through upper hatch 305. Modified cargo containers 306 may feed sand 306 or any other granular proppant therein through lower hatch 308 in modified cargo container 302 and upper hatch 310 into modified cargo container 304 located immediately there below. This was accomplished by opening the lower sliding door 312 in modified cargo container 302 and the upper sliding door 314 in modified cargo container 304. The sand 306 may either be transferred from the modified cargo container 302 into the modified cargo container 304 located immediately there below or delivered to a conveyer (not shown) located below the lower modified cargo container 304 by opening its lower sliding door 316 to open lower hatch 318. The sand flowing from the lower hatch 318 may be dumped on a belt (not shown), which will feed the sand to the blenders (not shown). In the blenders, the sand is mixed with the fracing fluid that will contain other chemicals therein prior to injection under pressure into the well being fraced at the frac site.

Figure 5:
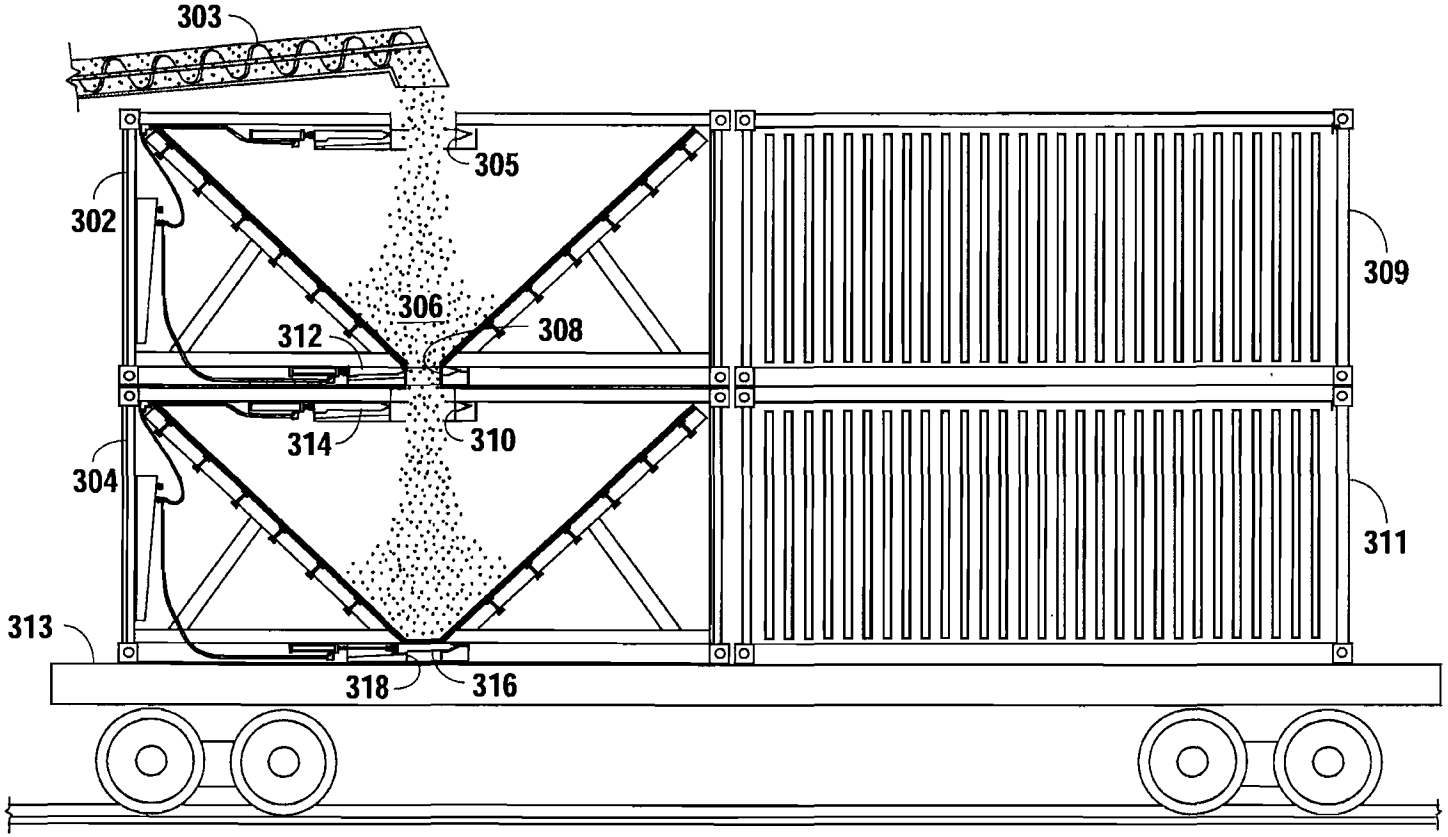
FIG. 5 is an elevated partial sectional side view showing sand flowing through stacked modified cargo containers.

However, rather than being located over a belt, FIG. 5 illustrates the loading of multiple modified cargo containers 302, 304, 309 and 311 while sitting on rail car 313.

Figure 6:
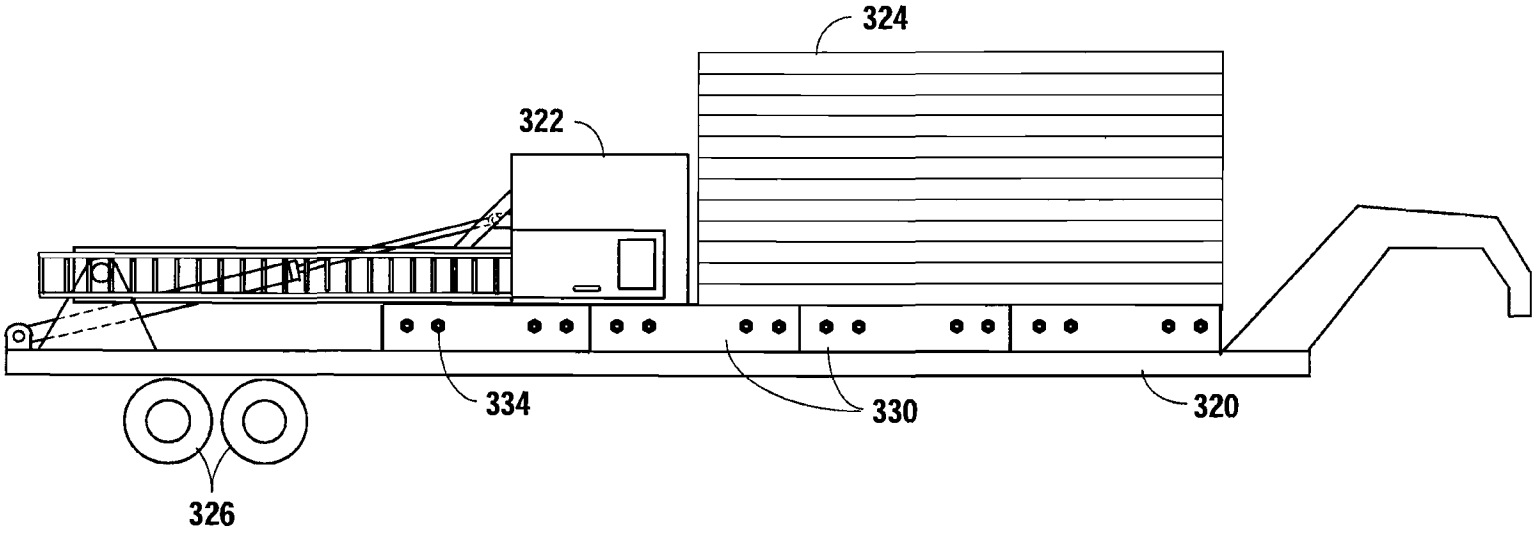
FIG. 6 is an elevated side view of a trailer that can be used with modified cargo containers filled with frac sand.
Figure 7:
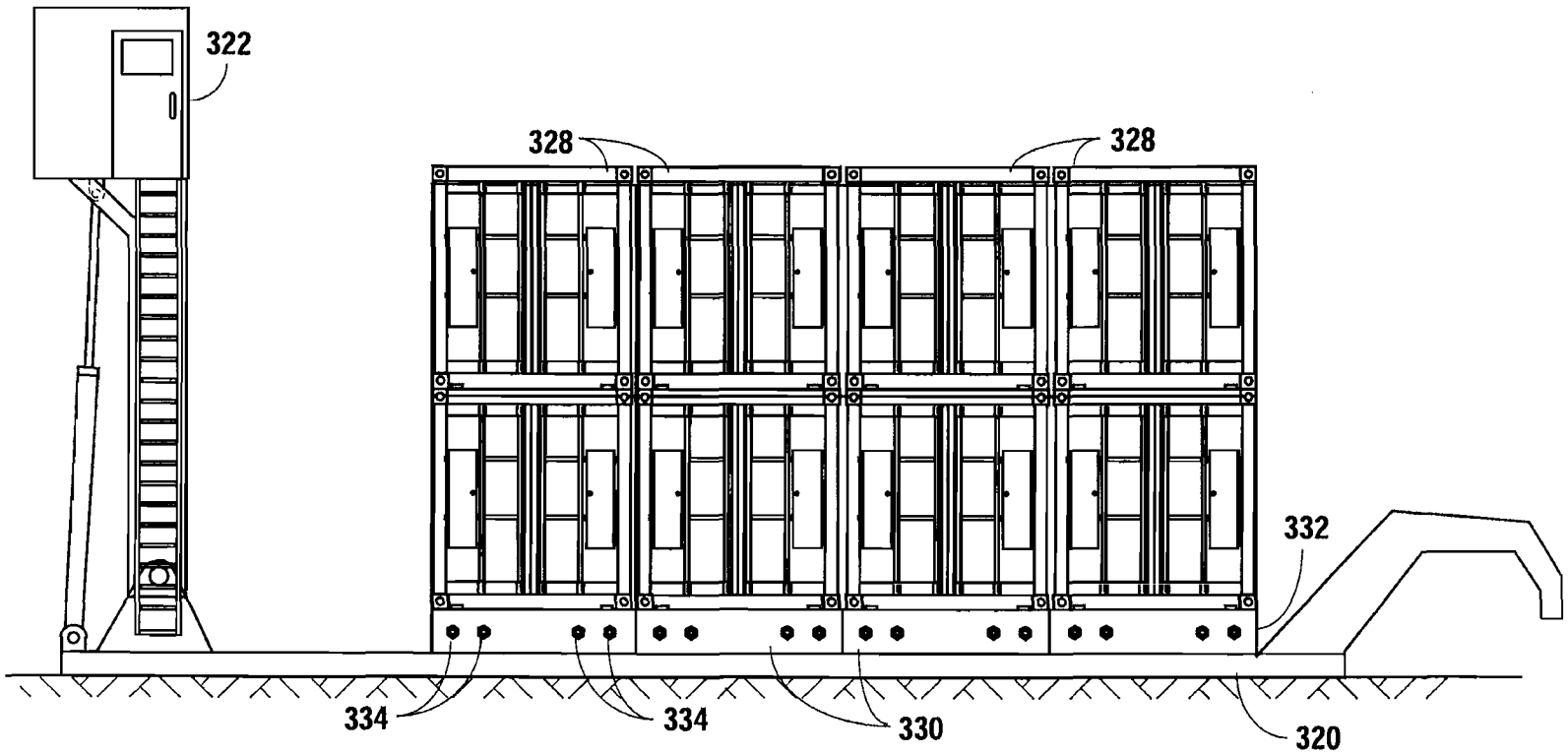
FIG. 7 is an elevated side view of the trailer being used with modified cargo containers thereon which can be filled with frac sand.
Figure 8:
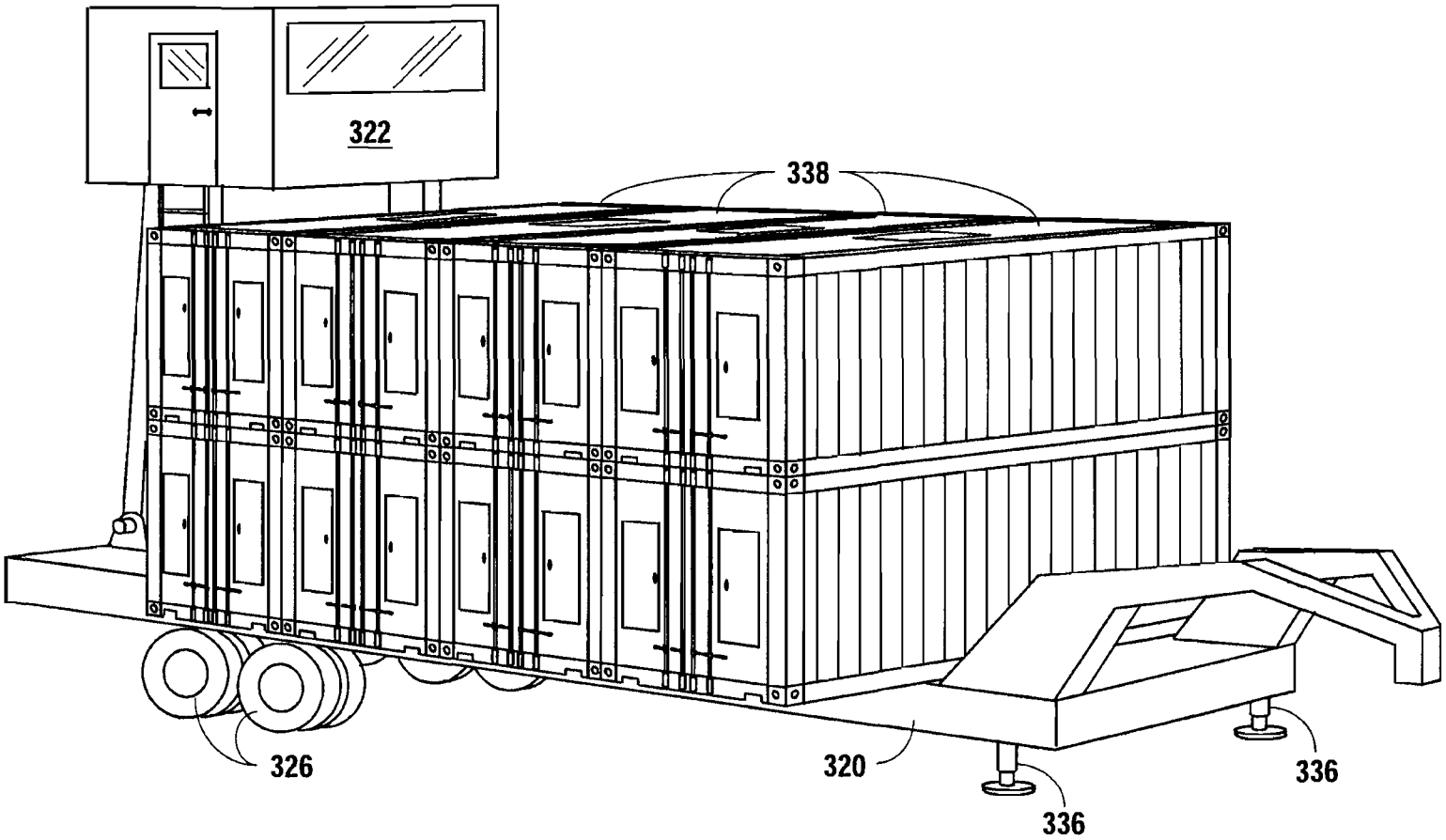
FIG. 8 is a perspective of the trailer shown in FIG. 7.

Referring to FIGS. 6, 7 and 8 in combination, a flatbed trailer 320 is used to create a super T-belt design. A control tower 322 is located on the back end of the flatbed trailer 320. In FIG. 6, the control tower 322 is laying down on the flatbed trailer 320 for movement to the frac site. Also, in FIG. 6, flat racks 324 are being transported to the frac site. Flat racks 324 may be used to the set the modified cargo containers thereon rather than setting them directly on the ground.

Upon arriving at the frac site with the flatbed trailer 320 as shown in FIG. 6, the control tower 322 is deployed as shown in FIG. 7 and the flat rack 324 removed. Also, the wheels 326 and axels (not shown) can be removed so that the flatbed trailer 320 sets directly on the ground as is illustrated in FIG. 7.

Also as illustrated in FIG. 7, modified cargo containers 328 are stacked one on top of the other with the lowermost modified cargo containers fitting directly over a belt system 330 located there below.

In FIG. 7, only the outside view of the belt system 330 is shown. However, fracing sand will be delivered through the dispensing end 332 of the belt system 330 to deliver the fracing sand to the blender. Hydraulic connections 334 may be used to control the operation of any of the sliding doors as previously described herein above. The hydraulic connections 334 may be controlled locally or remotely.

In the alternative, the above trailer 320 can be disconnected with front legs 336 being deployed. Thereafter, the modified cargo containers 338 may be simply stored on the flatbed trailer 320.

Figure 27:
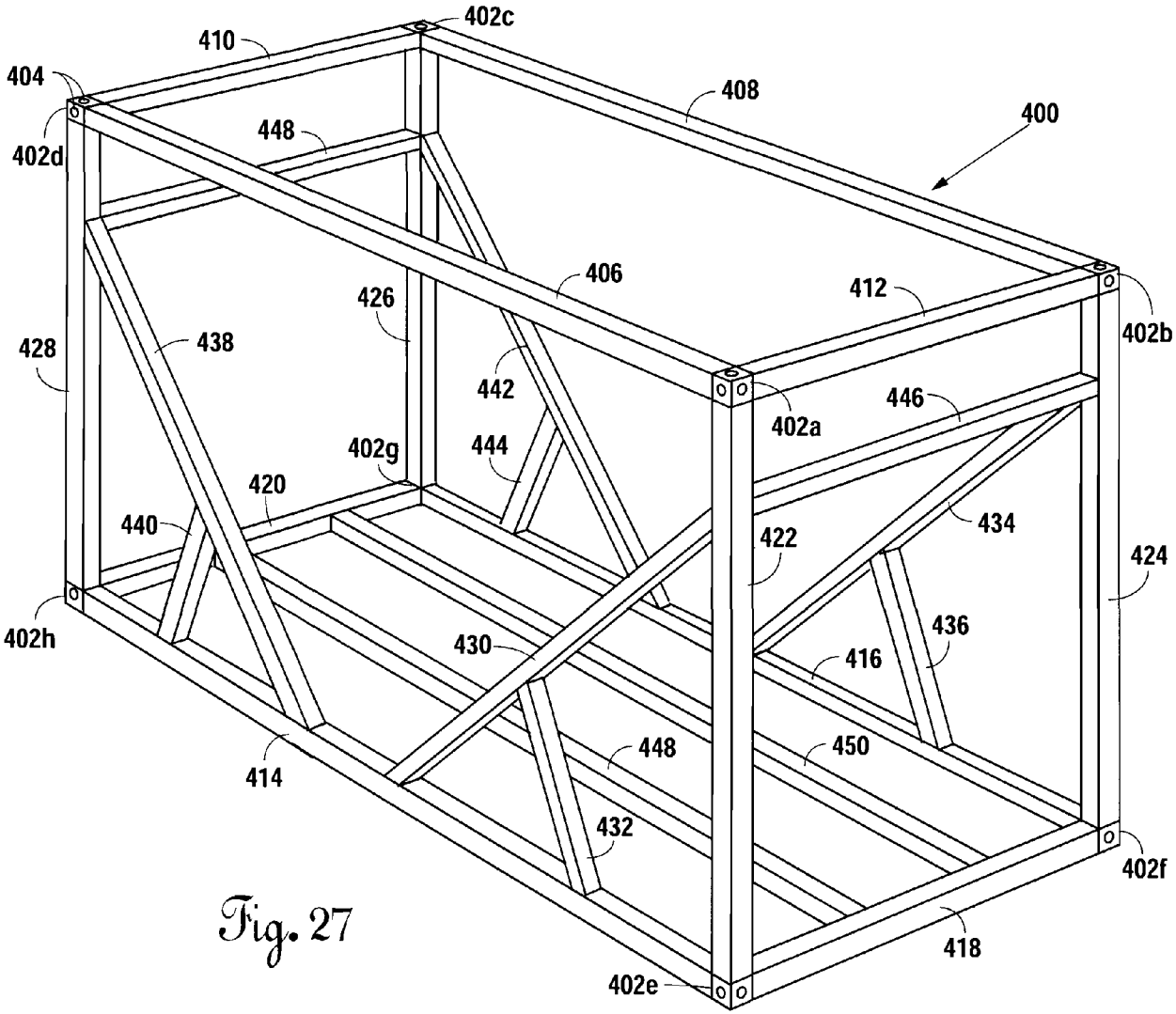
FIG. 27 is a perspective view of the frame (without the hopper) of a cargo container as illustrated in FIGS. 23-26.

Referring now to FIGS. 23-27 in combination, a cargo container specifically built to carry granular material such as a fracing sand is shown. Referring first to FIG. 27, a frame 400 for a cargo container is shown. Each corner of the frame 400 has a casting 402 with holes 404 therein for twist-lock fasteners (not shown). The castings 402 with the holes 404 therein are standard in most cargo containers. While each of the castings 402 at each corner is the same, herein below when it is necessary to refer to a particular casting, they will be given the sub-designation of "a", "b", "c", "d", "e", "f", "g", or "h".

Between the top castings 404*a*, 404*b*, 404*c* and 404*d* as shown in FIG. 27 are upper side rails 406 and 408 and upper end rails 410 and 412. The upper side rails 406 and 408 and upper end rails 410 and 412 are connected to the castings 404*a*, 404*b*, 404*c* and 404*d* by any convenient means such as welding.

At the bottom of frame 400, lower side rail 414 connects between castings 402*e* and 402*h* and lower side rail 416 connects between castings 402*f* and 402*g*. Lower end rail 418 connects between castings 402*e* and 402*f*. Lower end rail 420 connects between castings 402*g* and 402*h*. To complete the rectangular frame, corner posts 422 connects between castings 402*a* and 402*e*, corner posts 424 connects between castings 402*b* and 402*f*, corner posts 426 connects between castings 402*c* and 402*g* and corner posts 428 connects between castings 402*d* and 402*h*. The connections to the castings 402 may be of any convenient means such as welding.

Incline support 430 connects between corner posts 422 and lower side rail 414. The incline support 430 has a brace 432 connecting between incline support 430 and lower side rail 414. Likewise, incline support 434 connects between posts 424 and lower side rail 416. Incline support 434 is braced by brace 436 connecting to lower side rail 416.

On the opposite end, incline support 438 connects between corner post 428 and lower side rail 414. Brace 440 helps support incline rail 438 by connecting therefrom to lower side rail 414. Also, incline support 442 connects between corner post 426 and lower side rail 416. Incline support 442 is supported by brace 444 connecting therefrom to lower side rail 416.

At the upper end of incline support 430 and 434, an upper cross rail 446 extends between corner post 422 and corner post 424. On the opposite end of the frame 400, upper cross rail 448 extends between corner post 428 and 426 at the upper end of incline supports 438 and 442.

At the bottom of the frame 400 are lengthwise center rails 448 and 450. As will be described subsequently, the lower hatch (not shown in FIG. 27) is located between lengthwise center rails 448 and 450.

Figure 23:
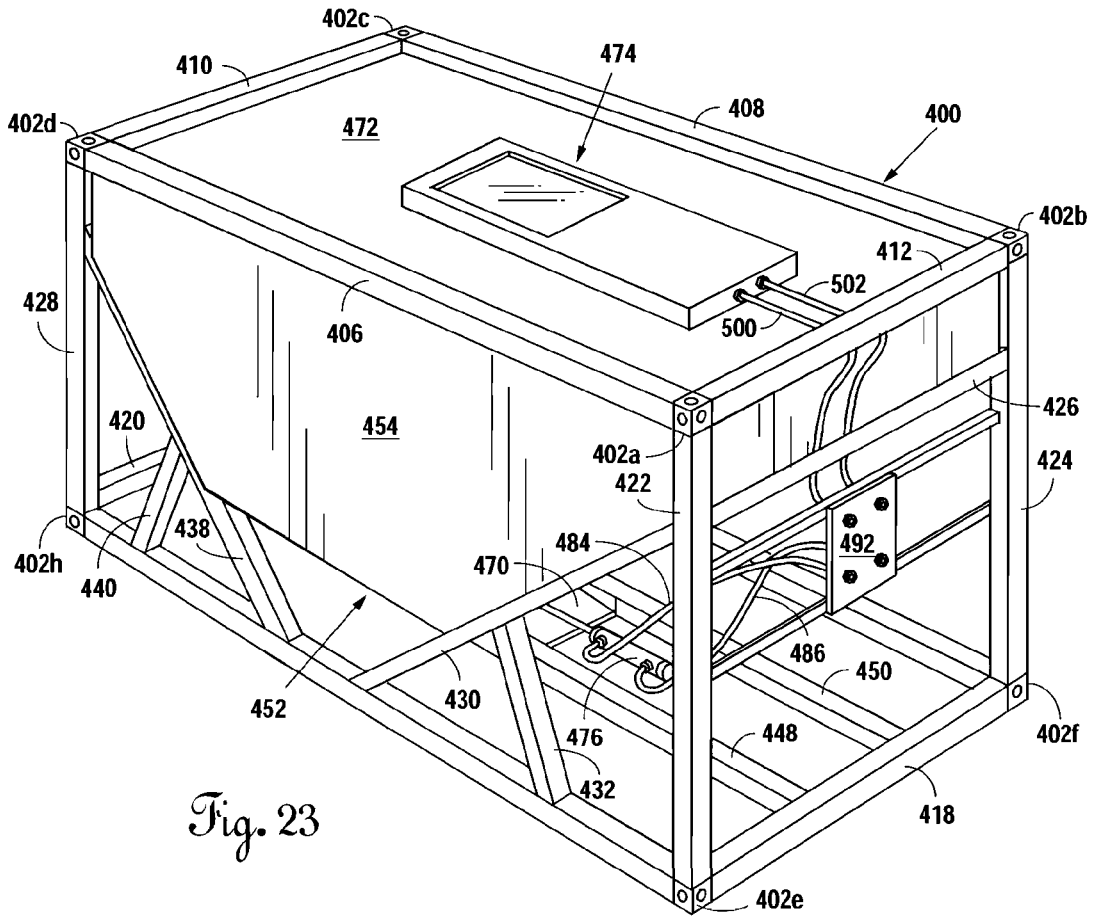
FIG. 23 is a perspective view of a cargo container that has a standard size frame with an enclosed hopper supported therein.
Figure 24:
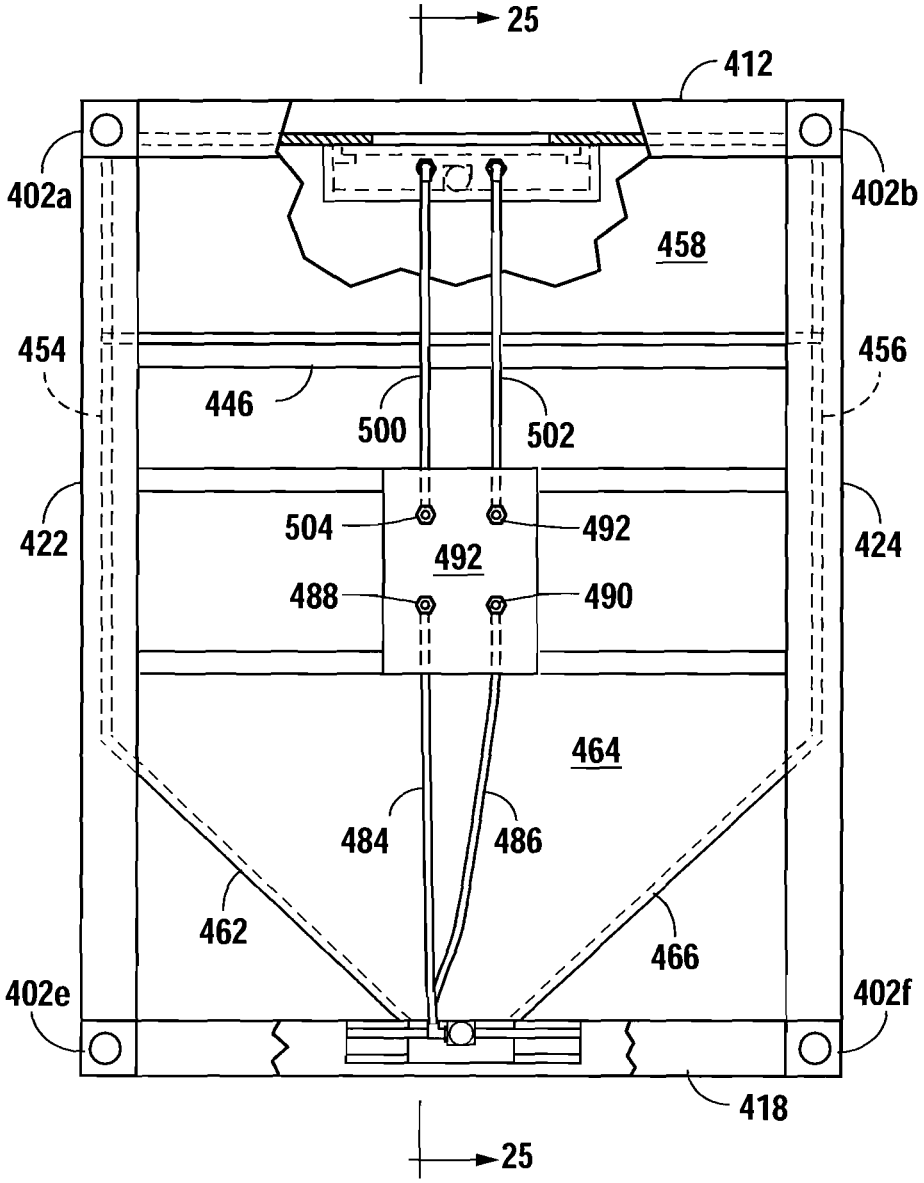
FIG. 24 is an end view of FIG. 23.
Figure 25:
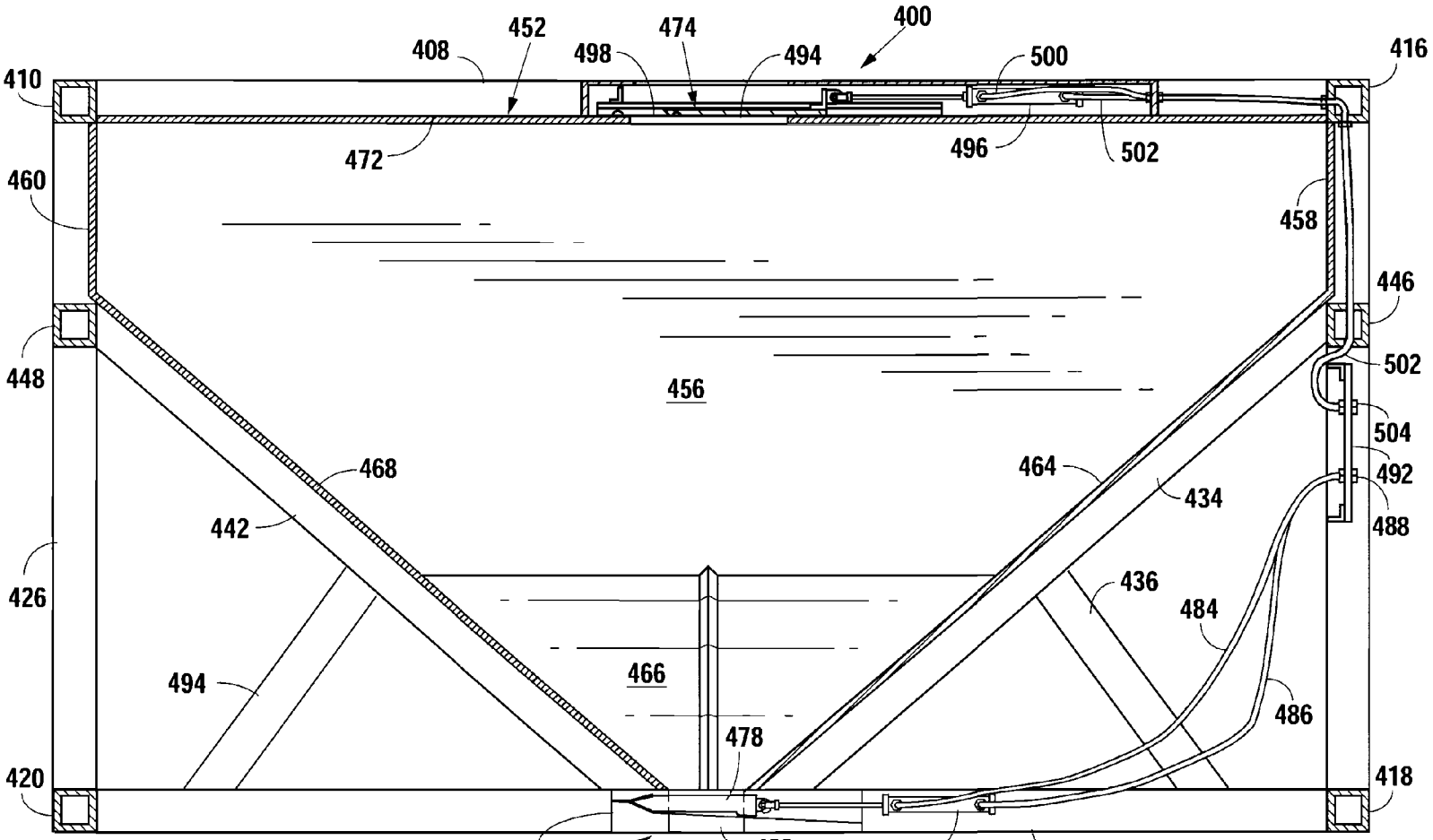
FIG. 25 is a sectional view of FIG. 24 along section lines 25-25.
Figure 26:
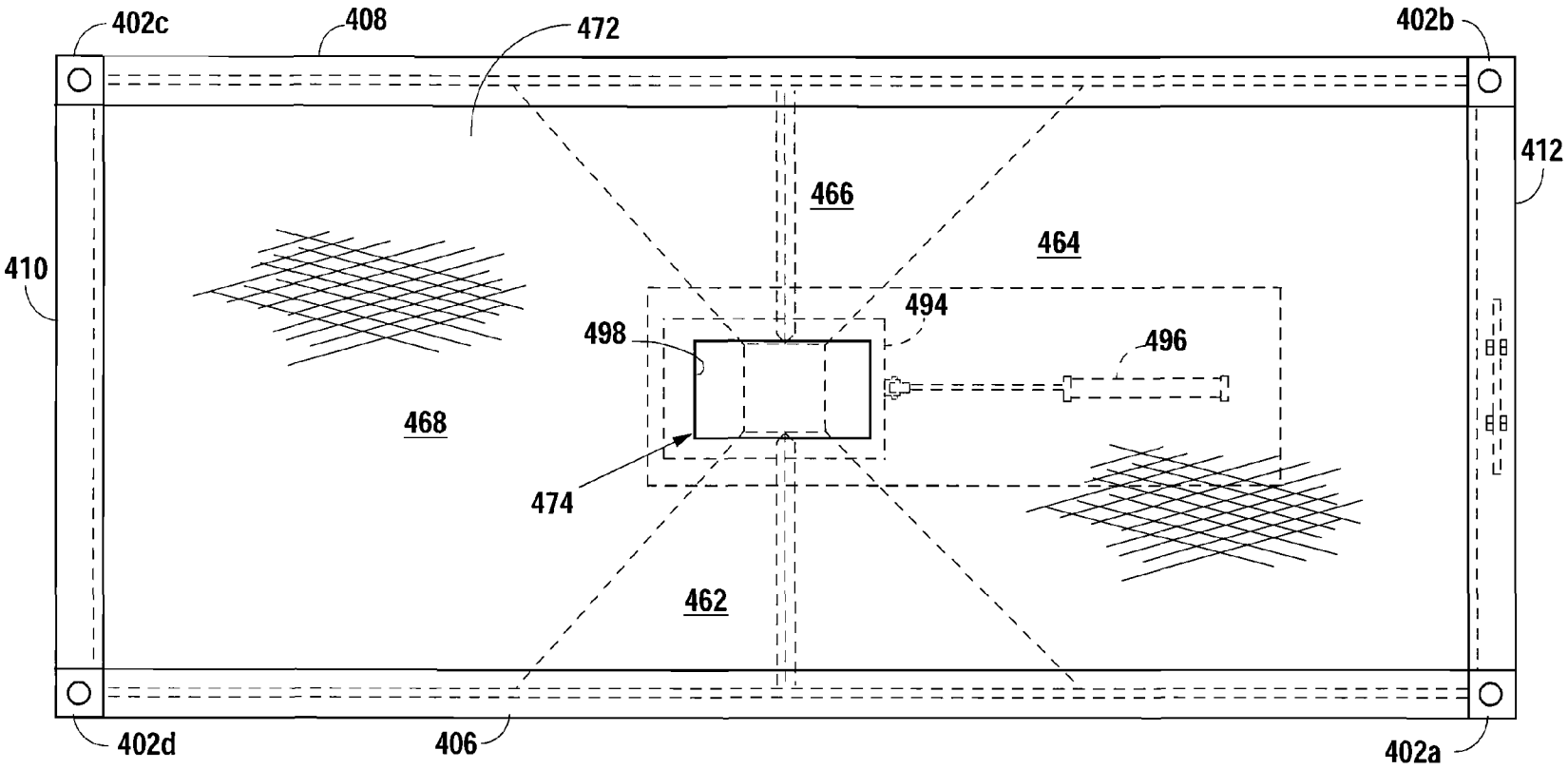
FIG. 26 is a top view of FIG. 24 with hidden lines being illustrated.

Referring now to FIG. 23, an enclosed hopper 452 is contained within the frame 400. Referring to FIGS. 23 and 25 in combination, the enclosed hopper 452 has a front wall 454, back wall 456, right end wall 458 and left end wall 460. Below the walls are located the front slope 462, right end slope 464, back slope 466 and left end slope 468, all of which slope down to the lower hatch 470 (see FIG. 26). The closing of the enclosed hopper 452 is complete with top 472, which has an upper hatch 474 therein.

Referring now to FIG. 25, the lower hatch 470 will be explained in more detail. The lower hatch 470 has a dual acting hydraulic cylinder 476 for operating the sliding gate 478 that comes to rest against cam blocks 480. When the sliding gate 478 is opened, opening 482 is opened, thereby allowing any granular material inside of enclosed hopper 452 to flow therefrom. By use of the cam blocks 480, the dual-acting hydraulic cylinder 476 can make a tight seal to close the opening 482 to prevent loss of granular material from the enclosed hopper 452. The lower hatch 470 including the dual acting hydraulic cylinder 476, sliding gate 478, opening 482 and cam blocks 480 are all located between and secured to lengthwise center rails 448 and 450 (see FIG. 27).

The dual-acting hydraulic cylinder 476 has hydraulic lines 484 and 486 that connect to hydraulic connectors 488 and 490 on connector panel 492. When someone wants to open or close the lower hatch 474, hydraulic hoses must be connected to the hydraulic connectors 488 and 490 to move the sliding gate 478 from the opened to the closed position or vice versa.

Concerning the upper hatch 474, it has a sliding gate 494 operated by hydraulic cylinder 496 to open or close upper opening 498. The movement of the hydraulic cylinder 496 and hence the sliding gate 494 is controlled by hydraulic fluid through hydraulic lines 500 and 502. Hydraulic lines 500 and 502 connect to hydraulic connectors 504 and 506, respectively, on hydraulic connector panel 492 (see FIG. 24). Because the hydraulic cylinder 496 is a dual-acting hydraulic cylinder, it requires hydraulic fluid to either open or close sliding gate 494.

By construction of a cargo container as described in FIGS. 23-27, a minimum amount of material is utilized. The frame 400 simply provides support for the enclosed hopper 452. To help protect the lower hatch 470, it is located between lengthwise center rails 448 and 450. The angle of front slope 462, right end slope 464, back slope 466 and left end slope 468 are all approximately equal to, or greater than, the angle of repose of the granular material being carried inside of the enclosed hopper 454. In that manner, when the sliding gate 478 of the lower hatch 470 is opened, all of the granular material may flow out of opening 482 of the enclosed hopper 452.

By construction of a cargo container as described and shown in FIGS. 23 through 27, a minimum of material is used, the empty cargo container weighs the minimum amount, yet the cargo container has the strength to carry a granular material such as sand. Most important, the cargo container can travel in the global containerized freight transportation system already in existence.

By use of the cargo containers as described herein above, the number of times the fracing proppant, such as sand, is handled is greatly reduced. The reduction in the number of times the fracing proppant is handled greatly reduces the cost of completion of a single hydrocarbon well.

Figure 28:
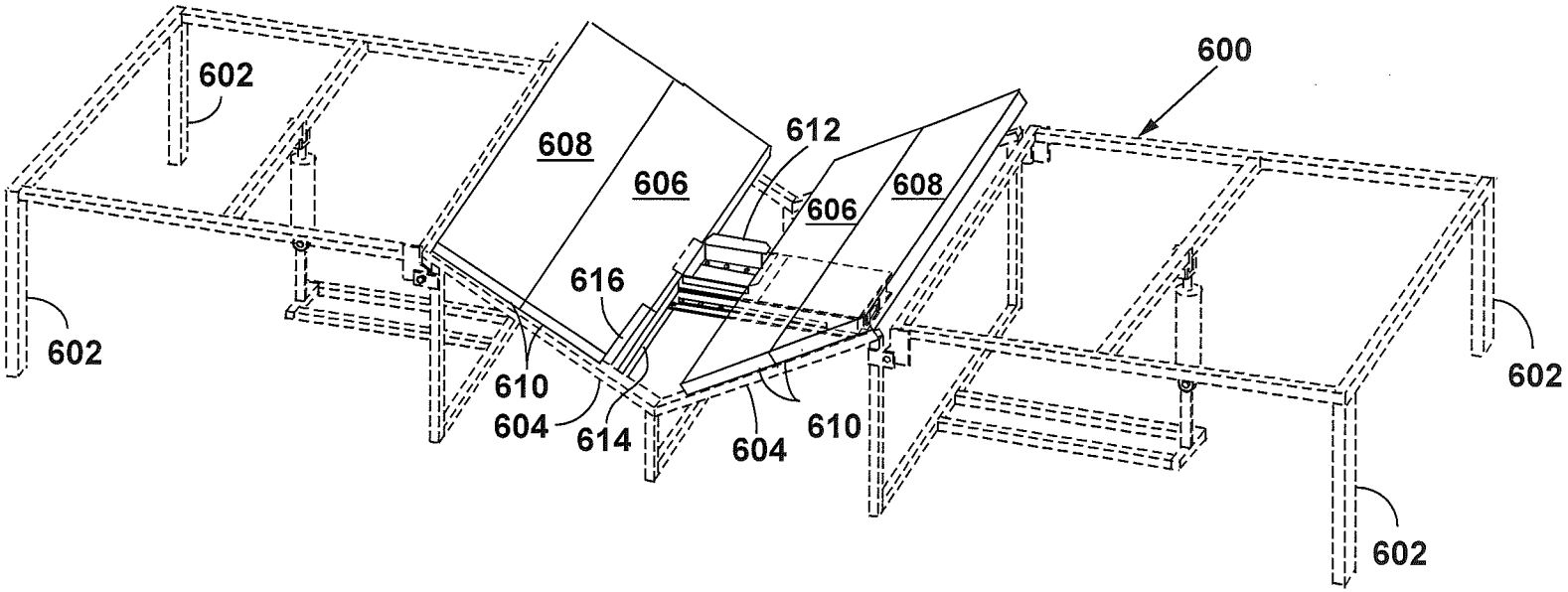
FIG. 28 is the first of sequential perspective views illustrating the construction of a hopper using bolted-together panels.
Figure 32:
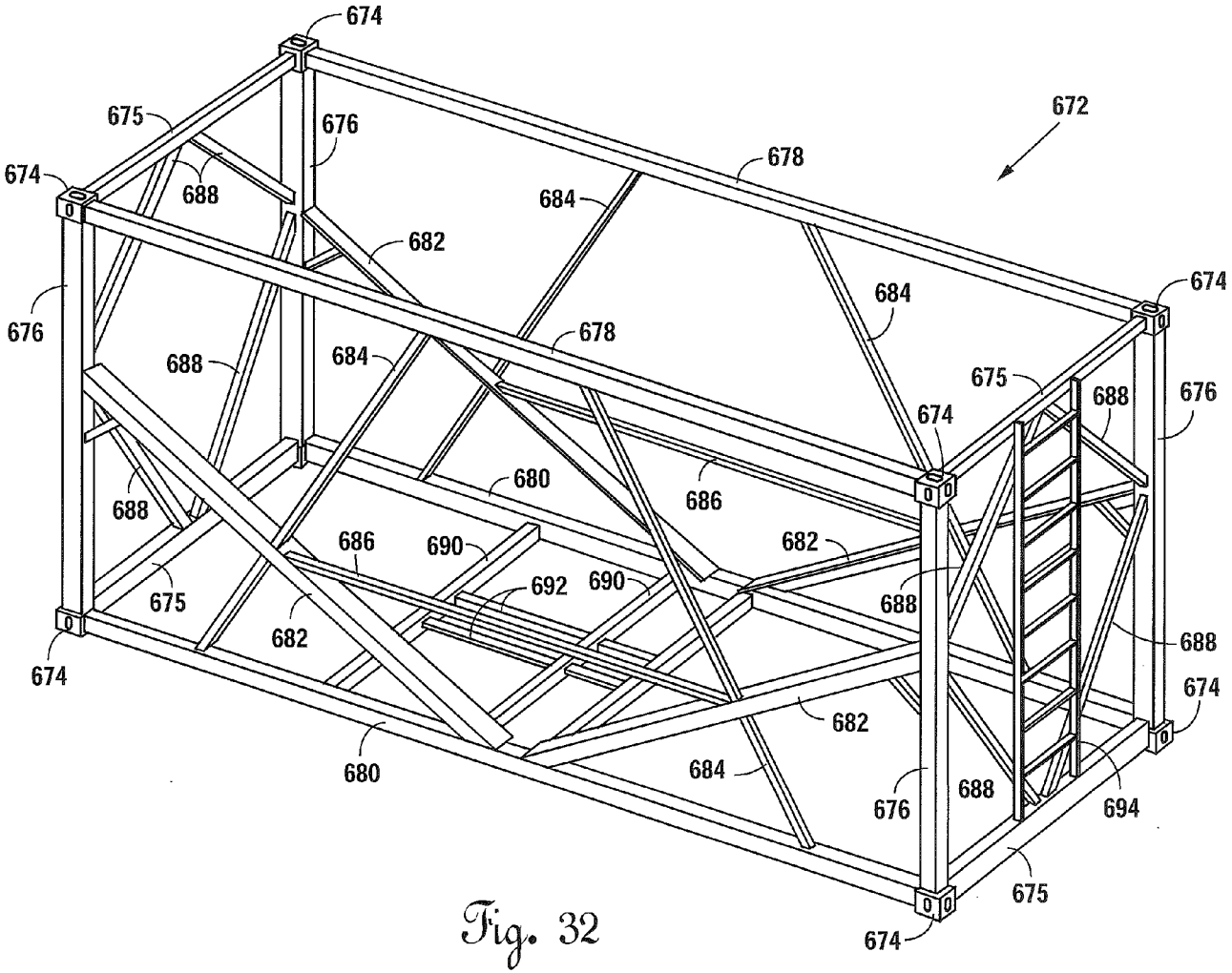
FIG. 32 is a perspective view of a frame that has the same outer dimensions as a standard cargo container.
Figure 33:
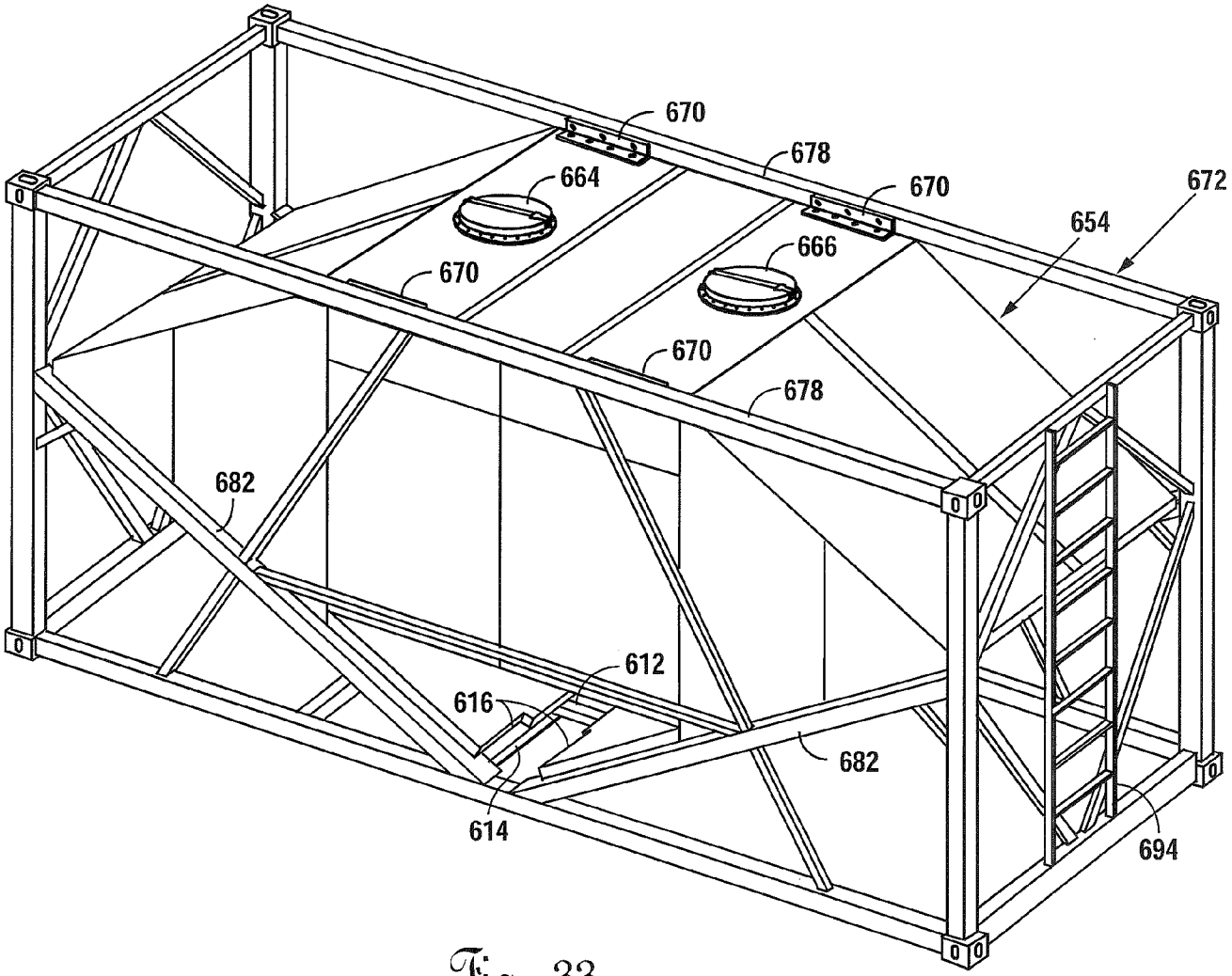
FIG. 33 is a perspective view of the frame shown in FIG. 32 with the hopper shown in FIG. 31 received therein.

Referring to FIGS. 28 through 42, an alternative embodiment for building a container in which granular material can be transported is shown. FIGS. 28 through 31 show sequential views for building a hopper out of sheet metal, which hopper would then fit inside of the frame as shown in FIGS. 32 and 33. Referring first to FIG. 28, a construction frame 600 is illustrated in dotted lines. The construction frame 600 has legs 602 for maintaining the construction frame at a predetermined level. In the center, the construction frame 600 has downwardly sloped frame members 604. On the downwardly sloped frame members 604 are contained lower hopper panels 606 and 608. The edges 610 of the lower hopper panels 606 and 608 are folded downward and perpendicular to the surface of the lower hopper panels 606 and 608. A lower sliding gate 612, as will subsequently be explained in more detail in connection with FIG. 39, is attached to lower hopper panels 606. Also attached to the bottom of the lower sliding gate 612 is sock holder slide 614. Notch 616 allows the sock holder shown in FIG. 40 to be inserted into sock holder slide 614.

Figure 41:
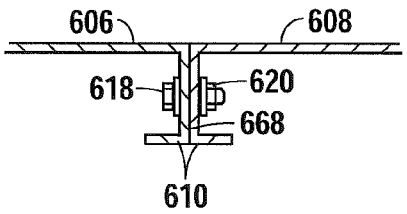
FIG. 41 is a cross sectional view of the bolt-together connection on the bottom or side panels of the hopper.

Lower hopper panel 606 bolts to lower hopper panel 608 in a manner as shown in FIG. 41. The edges 610 of lower hopper panel 606 and lower hopper panel 608 are bolted together by bolts 618 as illustrated in the partial sectional view shown in FIG. 41. Bolts 618 and nuts 620 bolt together the lower hopper panels 606 and 608.

Figure 29:
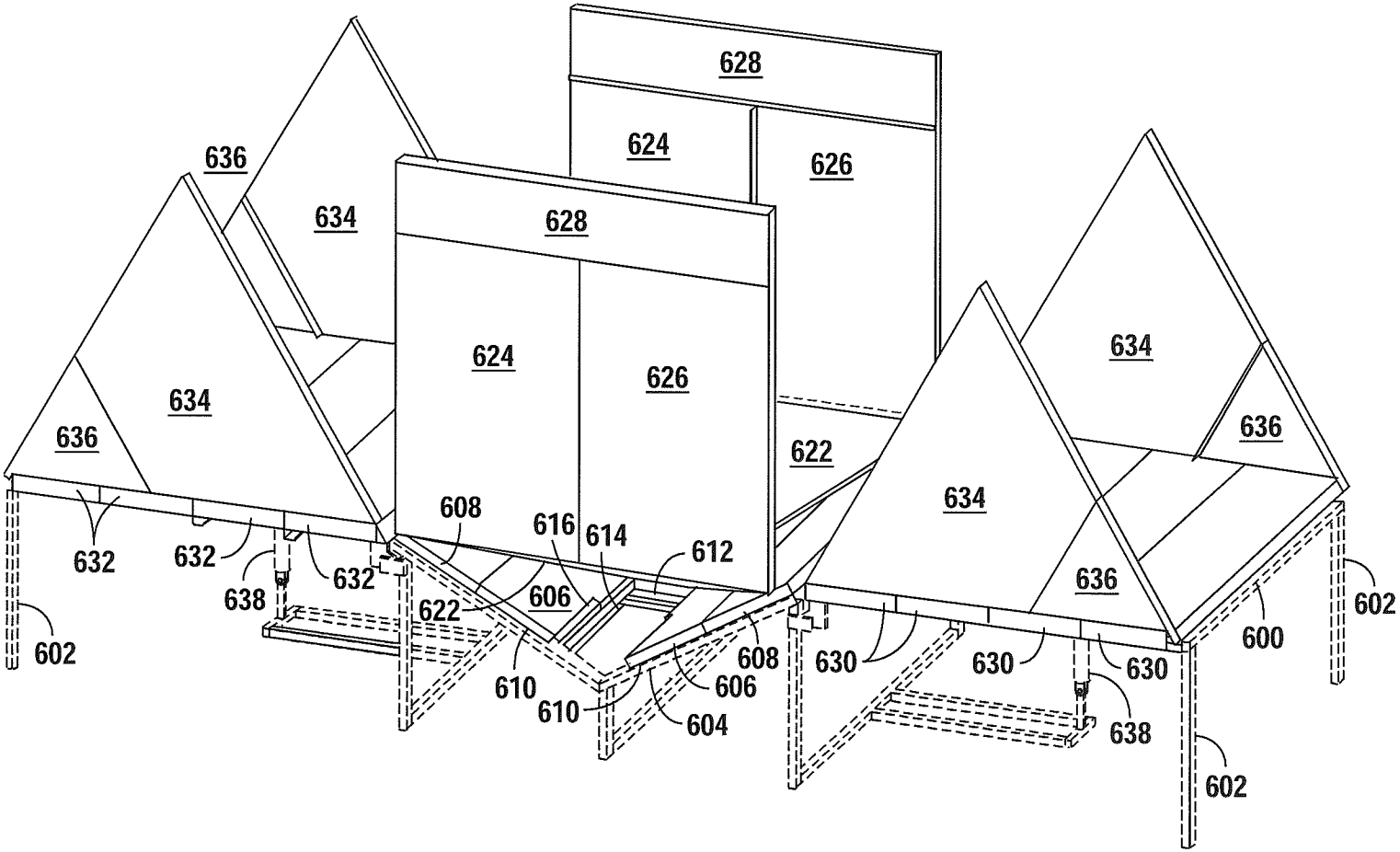
FIG. 29 is the second of sequential perspective views illustrating the construction of a hopper using bolted-together panels.

Referring now to FIG. 29, the construction frame 600 has numerous additional panels that have been added. Lower hopper side panels 622 feed downward to the lower sliding gate 612.

The lower hopper side panels 622 connect to vertical panels 624 and 626. Across the top of vertical panels 624 and 626 are upper side panel strips 628. End hopper panel strips 630 and 632 are laid out on each end of a construction frame 600 and are bolted together in a manner as shown in FIG. 41. Bolted to the end hopper panel strips 630 and 632 are trapezoidal side panels 634 and triangular side panels 636.

Figure 30:
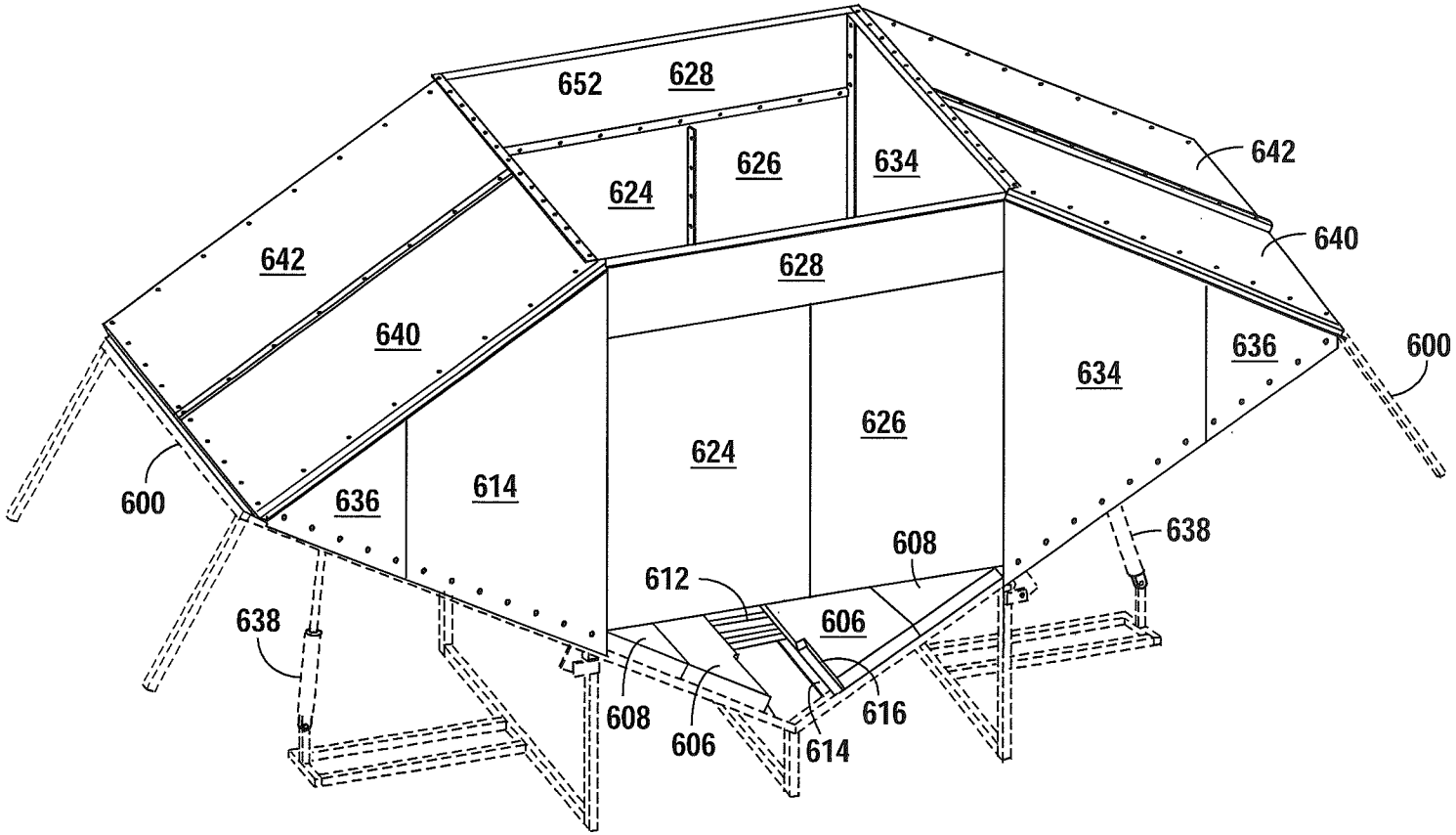
FIG. 30 is the third of sequential perspective views illustrating the construction of a hopper using bolted-together panels.

After all of the panels are laid out on the construction frame 600 and the various panels being attached together, the ends of the construction frame 600 are raised by the hydraulic cylinders 638 as illustrated in FIG. 30. Once raised into position, all of the panels are bolted together as illustrated in FIG. 30 with the bolted connection being illustrated in FIG. 41.

Also bolted in place on the trapezoidal side panels 634 and triangular side panels 636 are top end panels 640 and 642. The type of connection between top end panels 640 and 642 is illustrated in partial sectional view of FIG. 42 where edge 644 folds over edge 646. The edges 644 and 646 are bolted together by bolts 648 and nuts 650. The purpose of edge 644 folding over edge 646 is to keep moisture from leaking between the bolted together connection.

With the exception of joint 652, none of the edges being joined together will impede granular material from flowing downward to the lower sliding gage 612. Therefore, joint 652 is flattened against upper side panel strips 628.

Figure 31:
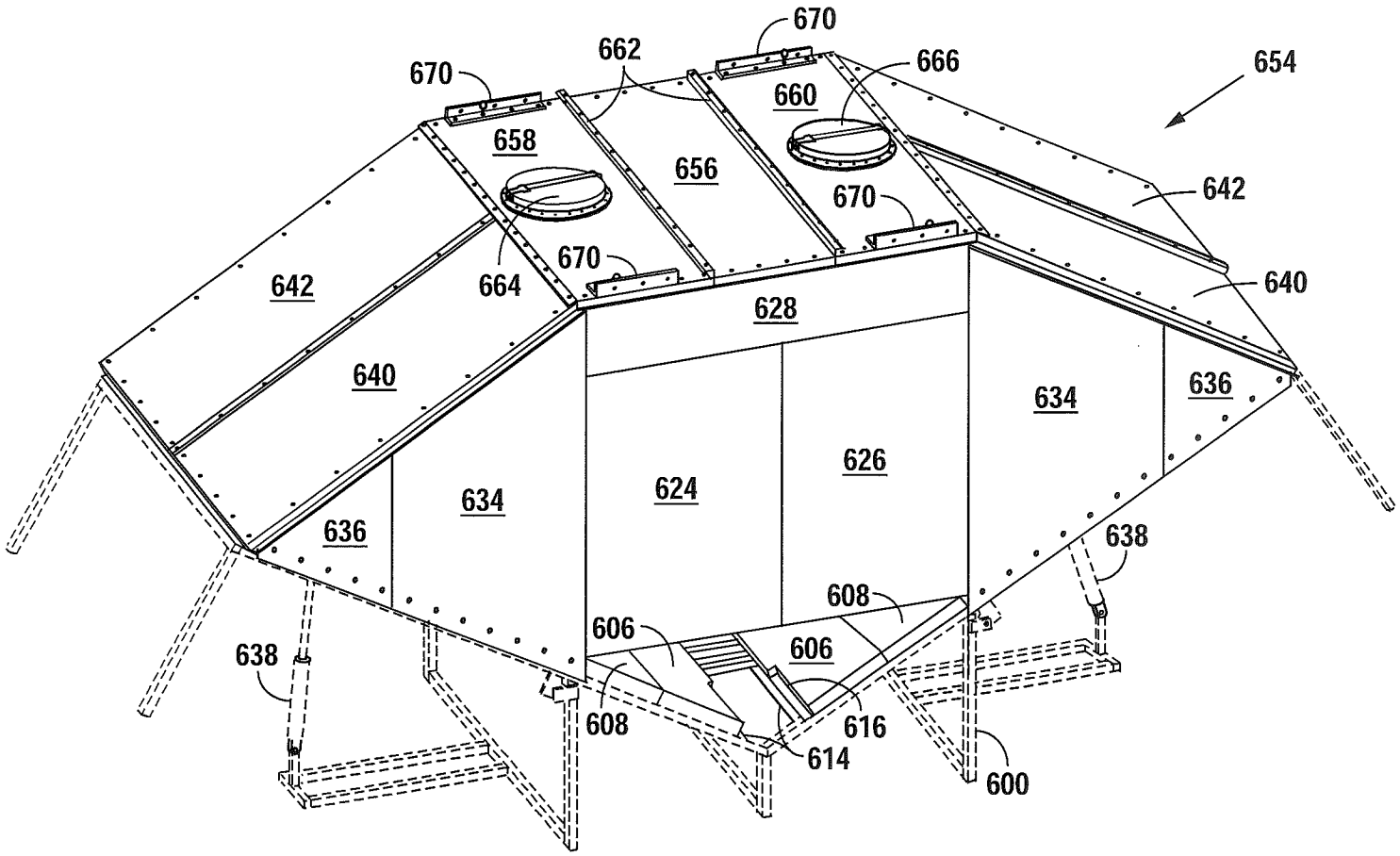
FIG. 31 is the fourth of sequential perspective views illustrating the construction of a hopper using bolted-together panels.
Figure 42:
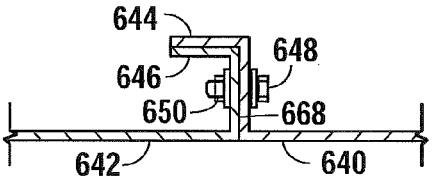
FIG. 42 is a cross sectional view of the bolt-together connection on the top panels of the hopper.

Referring now to FIG. 31, the hopper 654 is completed by adding a top center panel 656 with a left end top hatch panel 658 and right end top hatch panel 660. The edges 662 are bolted together in a manner as illustrated in FIG. 42. Within the left end top hatch panel 658 is located the left hatch 664. Within the right end top hatch panel 660 is located right hatch 666. By opening left hatch 664 and/or right hatch 666, granular material can be inserted inside of the hopper 654.

Referring to FIGS. 41 and 42, a butyl rubber sealant tape 668 is used between edges 610 or edges 644 and 646. The butyl rubber sealant tape 668 may be a 10B-10A sealant tape, such as manufactured by GSSI Sealants as can be seed on their website of www.gssisealants.com. The butyl rubber sealant tape 668 can be used to seal all of the cracks in the hopper 654.

The various panels as previously described in connection with FIGS. 28-31 can be G90 galvanized metal, ASTM-A527. While other metals can be used for the panels, this particular galvanized metal has been found to be well suited for hauling granular material.

Referring now to FIG. 32, a frame 672 is shown. The frame 672 is generally made from carbide steel structural tubing (that meet ASTM-A500). At the corners 674 of the frame 672 are ISO Tandem Locks corner fittings. Corner posts 676 are located at each vertical corner of the frame 272, which corner posts 676 connect between corners 674. Upper side rails 678 connect between the corners 674 at the top of frame 672. Lower side rails 680 connect between the corners 674 and the bottom of the frame 672. End rails 675 connect between corners 674.

To give extra strength to the frame 672, lower diagonal braces 682 provide bracing between the lower side rails 680 and the corner post 676. Upper diagonal braces 684 provide bracing between the upper side rails 678 and the lower side rails 680. The upper diagonal braces 684 also connect through the lower diagonal braces 682. Horizontal braces 686 connects between the lower diagonal braces 682.

Each end of the frame 672 has a series of end diagonal braces 688 connecting between the corner posts 676. The lower side rail 680 has three cross bars 690 that are used to support the lower sliding gate 612 (not shown herein). The cross bars 690 has gate support rails 692 extending there between. At the end of the frame 672 is located a ladder 694, which ladder 694 is contained within the space of the frame 672 as defined by the corners 674.

Referring now to FIG. 33, the hopper 654 is placed inside of the frame 672 with the hopper 654 resting on the lower diagonal braces 682. The top of the hopper 654 is attached to the upper side rails 678 by bolting to mounting flanges 670.

The hopper 654 as illustrated in FIG. 33 can be filled by left hatch 664 or right hatch 666. By filling through both hatches 664 and 666, a more even distribution of the granular material can be inserted into hopper 654.

It has been found that a hopper 654 of the dimension as illustrated along with a truck and trailer generally will reach the maximum limit of 80,000 lbs. which maximum limit is the most that can travel on major roads in the United States.

If someone needs to get on the top of the hopper 654, they can do so by climbing up ladder 694 and by reaching hatches 664 of 666.

Figure 34:
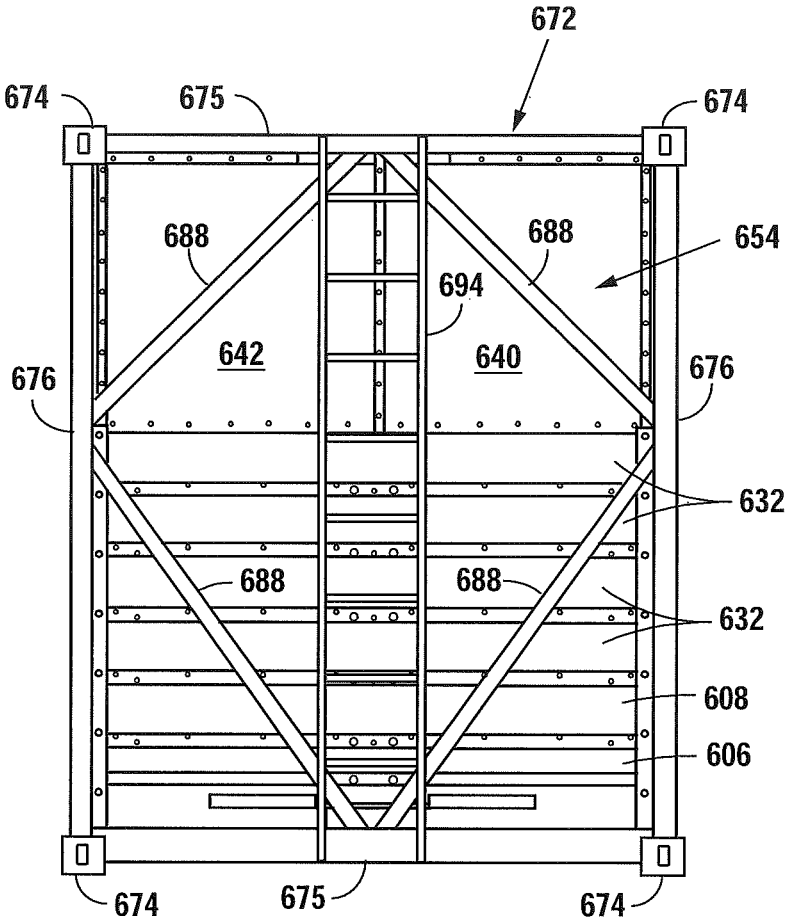
FIG. 34 is a right end view of FIG. 33.

Referring now to FIG. 34, a right hand view of FIG. 33 is provided. The frame 672 is clearly shown with the hopper 654 therein. The ladder 694 allows access to the top of the frame 672 and/or hopper 654. Corner posts 676 connect between the corners 674. End rails 675 also connect between corners 674.

In FIG. 34, the lower hopper panels 606 and 608 can be seen as well as the end hopper panel strips 632. Also, the top end panels 640 and 642 are clearly shown.

Figure 35:
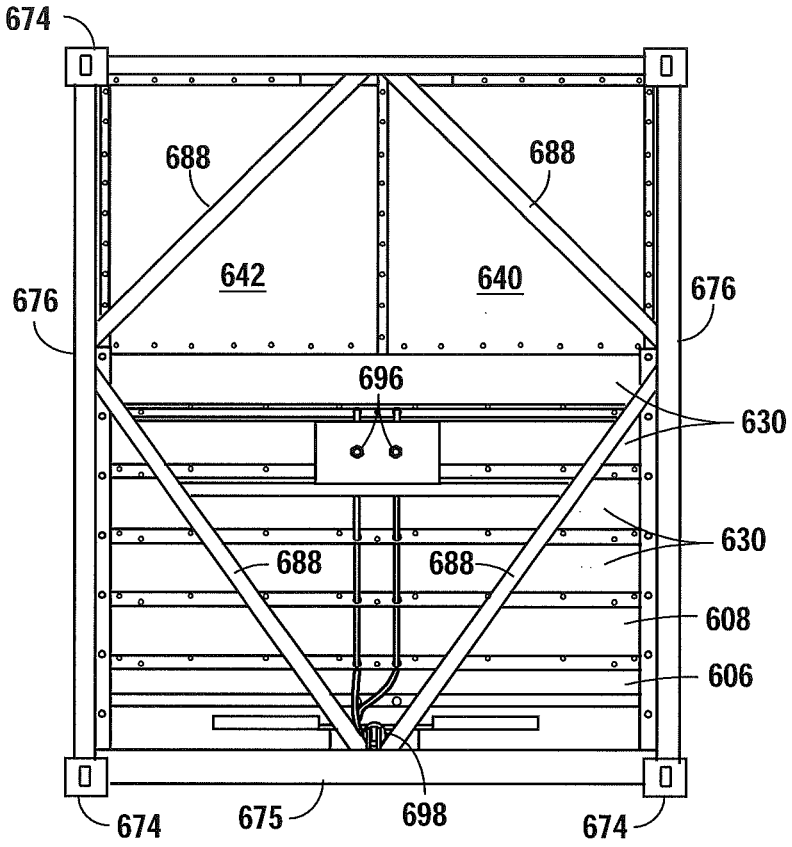
FIG. 35 is a left end view of FIG. 33.

Referring now to FIG. 35, view 35 is the right end view 34, except the ladder 694 has been removed and hydraulic connections 696 are provided to operate the hydraulic cylinder 698 to open or close the lower sliding gate 612 (not shown in FIG. 35). By connecting to the hydraulic connection 696, the lower sliding gate 612 (not shown in FIG. 35) can be operated via hydraulic cylinder 698.

Figure 36:
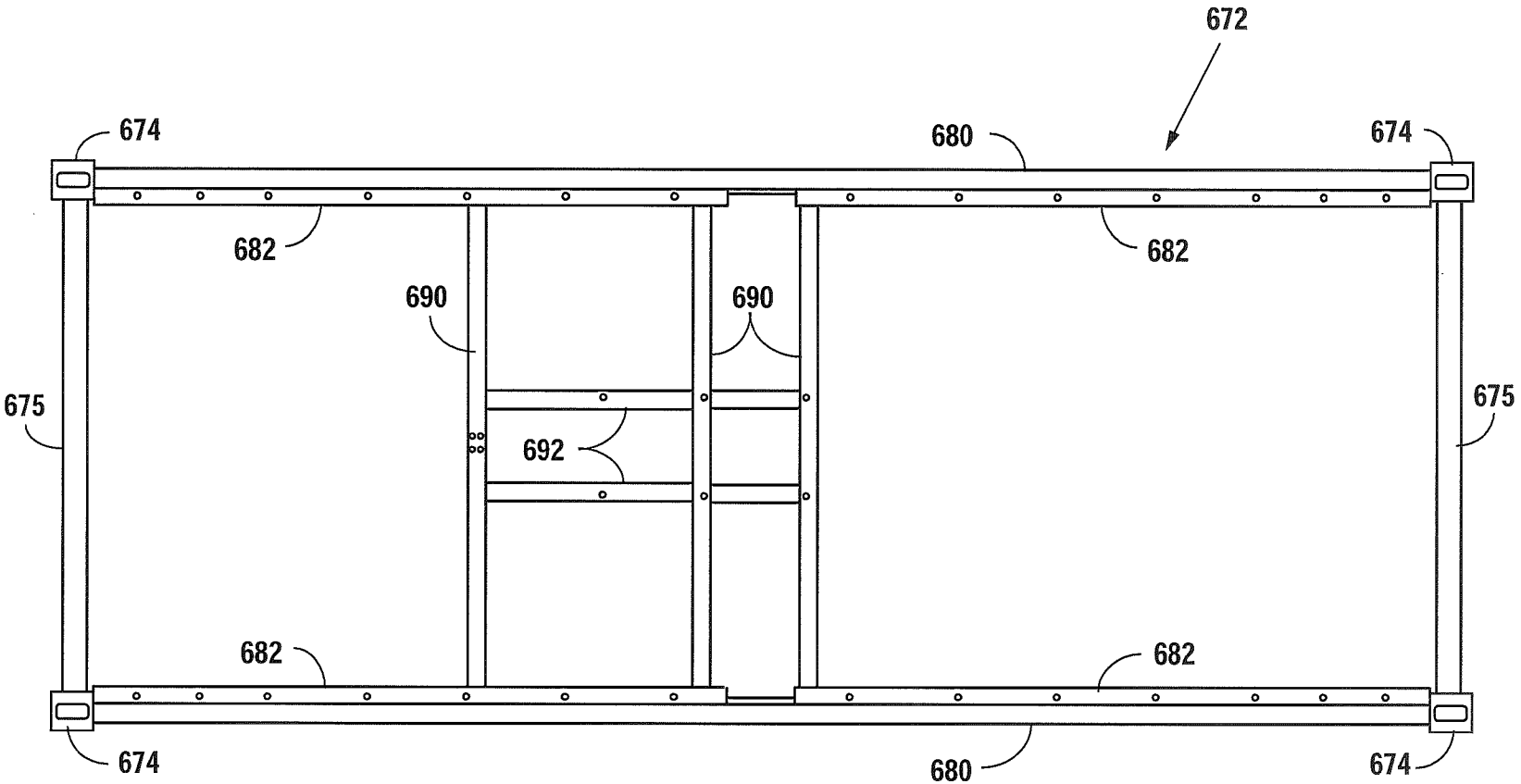
FIG. 36 is a bottom view of the frame shown in FIG. 32.

Referring now to FIG. 36, a bottom view of the frame 672 is shown. The corners 674 are connected by lower side rails 680 and end rails 675. Cross bars 690 extend between lower side rails 680. Gate support rails 692 will support the lower sliding gate 612 (not shown in FIG. 36). The lower diagonal braces 682 against which the hopper 654 (not shown in FIG. 36) will rest extend inside of lower side rails 680.

Figure 37:
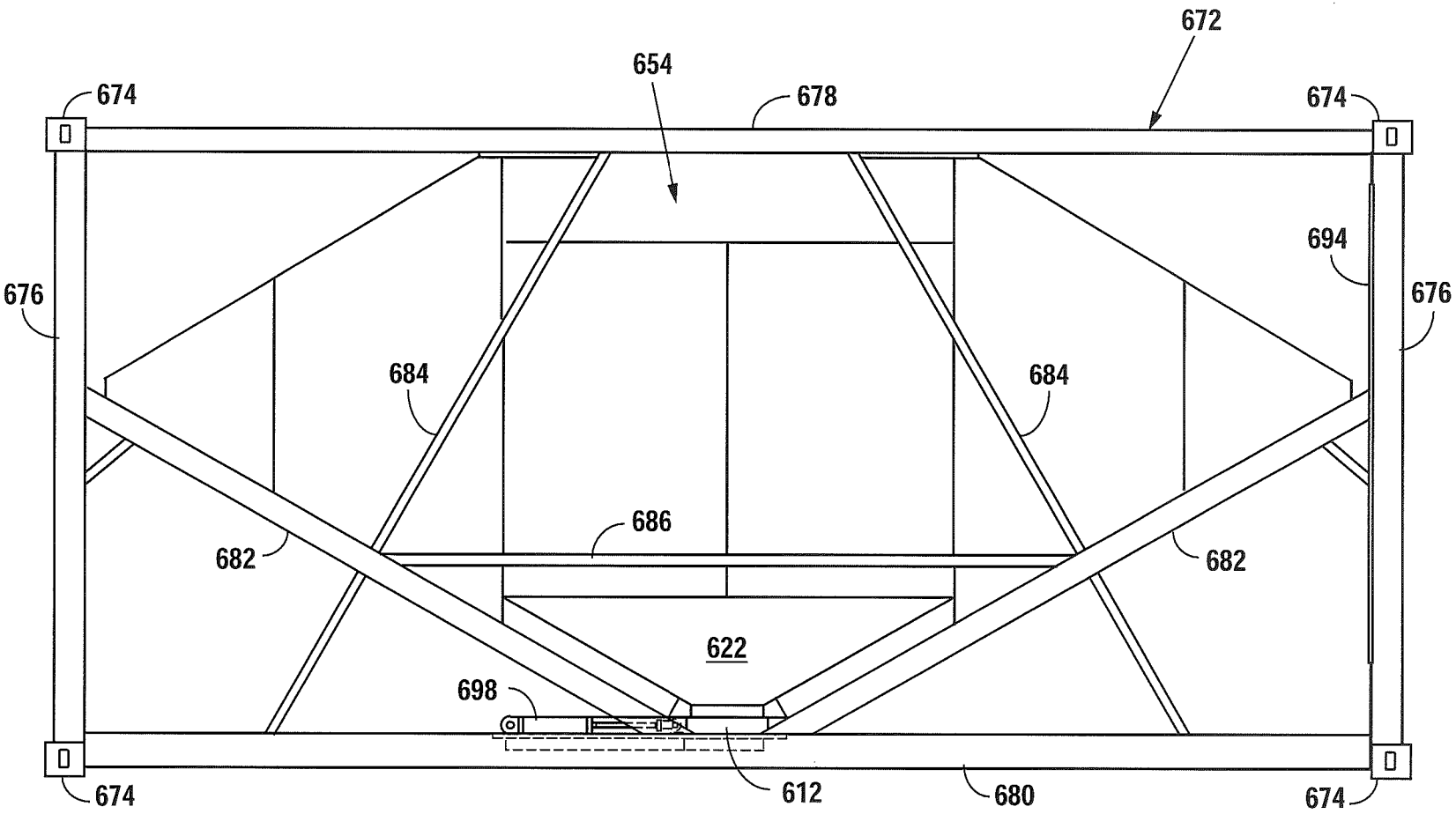
FIG. 37 is a side view of FIG. 33.

Referring now to FIG. 37, a side view of FIG. 33 is shown. The corners 674 are connected by corner posts 676, upper side rails 678 and lower side rails 680. The lower diagonal braces 682 connect between the corner posts 676 and lower side rail 680. Upper diagonal braces 684 connect between the upper side rails 678 and the lower side rails 680. Horizontal braces 686 provides additional bracing support. The hopper 654 as located inside of frame 672 and rests against lower diagonal braces 682. At the bottom of hopper 654, side lower hopper panels 622 directs the granular material inside of hopper 654 to the lower sliding gate 612. The lower sliding gate 612 is opened or closed by the hydraulic cylinder 698.

Referring now to FIG. 39, a pictorial view of the lower sliding gate 612 is shown. The hydraulic cylinder 698 is used to operate a slide (not shown in FIG. 39) that opens or closes the opening 700 to open and close the lower sliding gate 612. C-channels 702 are attached to opposing sides of lower sliding gate 612, which C-channels 702 may be connected to gate support rails 692

Figure 40:
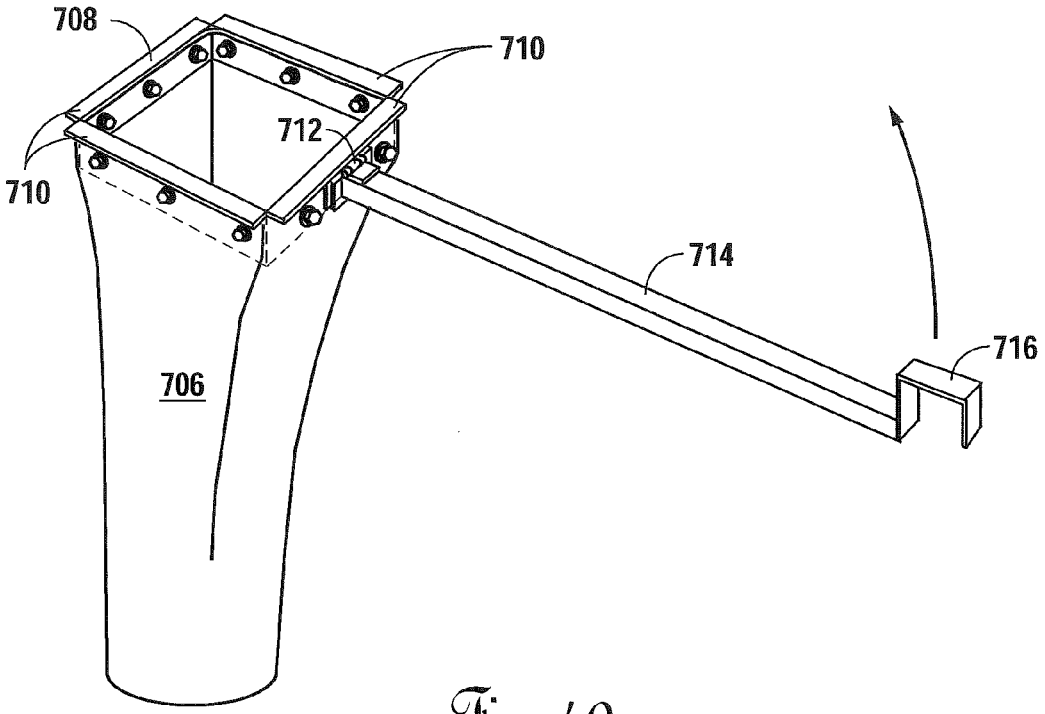
FIG. 40 is a perspective view of a sock used to prevent dust during the unloading of the container illustrated in FIG. 33.

Referring now to FIG. 40, a discharge sock is pictorially illustrated that can reduce dust when unloading granular material from the hopper 654. A sock 706 is connected to a rectangular frame 708, which rectangular frame 708 has outwardly directing flanges 710. The flanges 710 are received inside of the sock holder slide 614 (see FIGS. 31 and 33). The rectangular flange 708 connects through hinge 712 to handle 714, which hinge 712 also connects to the flanges 710. The handle 714 has a C-shape 716 on the end thereof, which C-shape 716 may clamp over the lower side rail 680 to hold the sock 706 in place below the opening 700 for the lower sliding gate 612.

Figure 38:
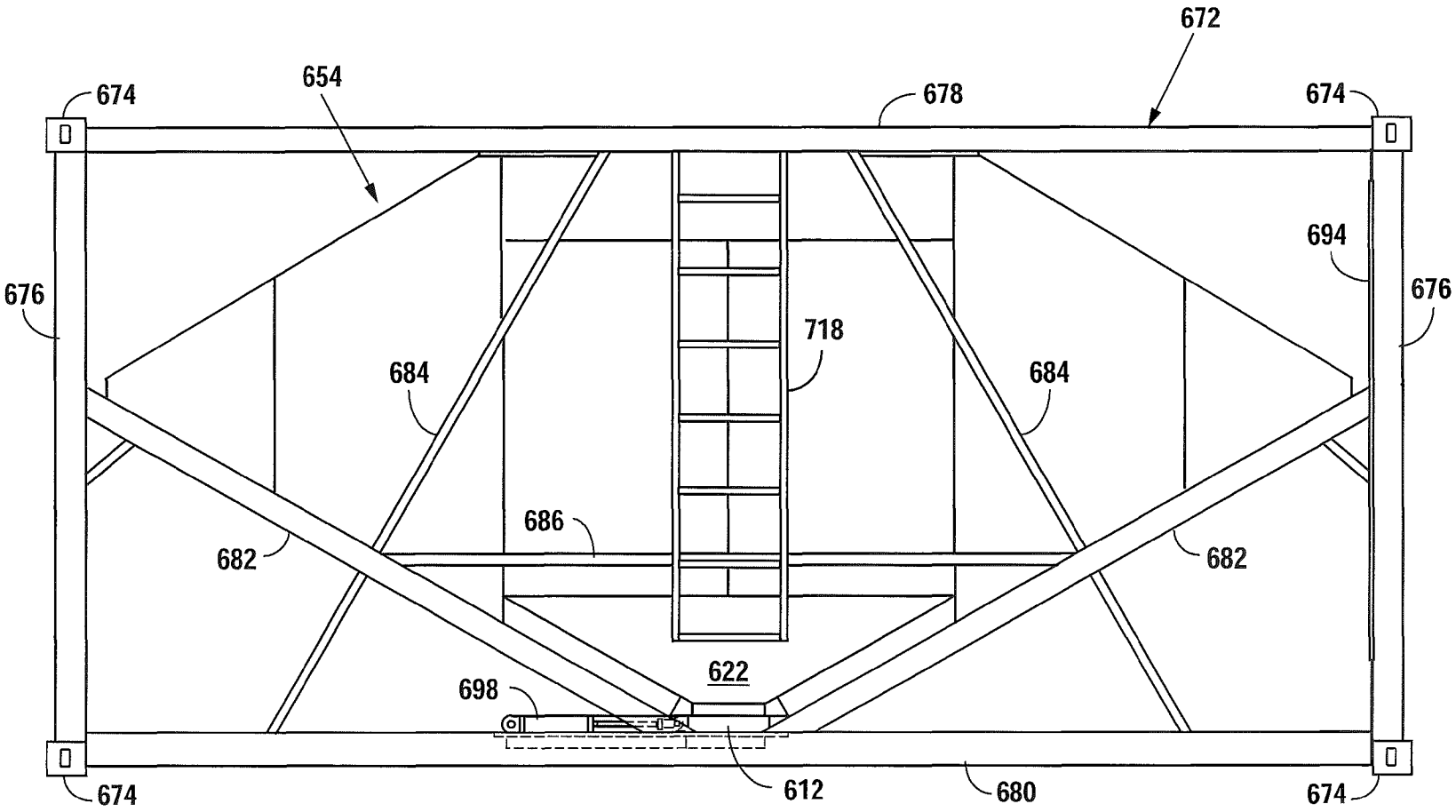
FIG. 38 is an alternative side view of FIG. 33 showing the ladder on the side thereof.
Figure 39:
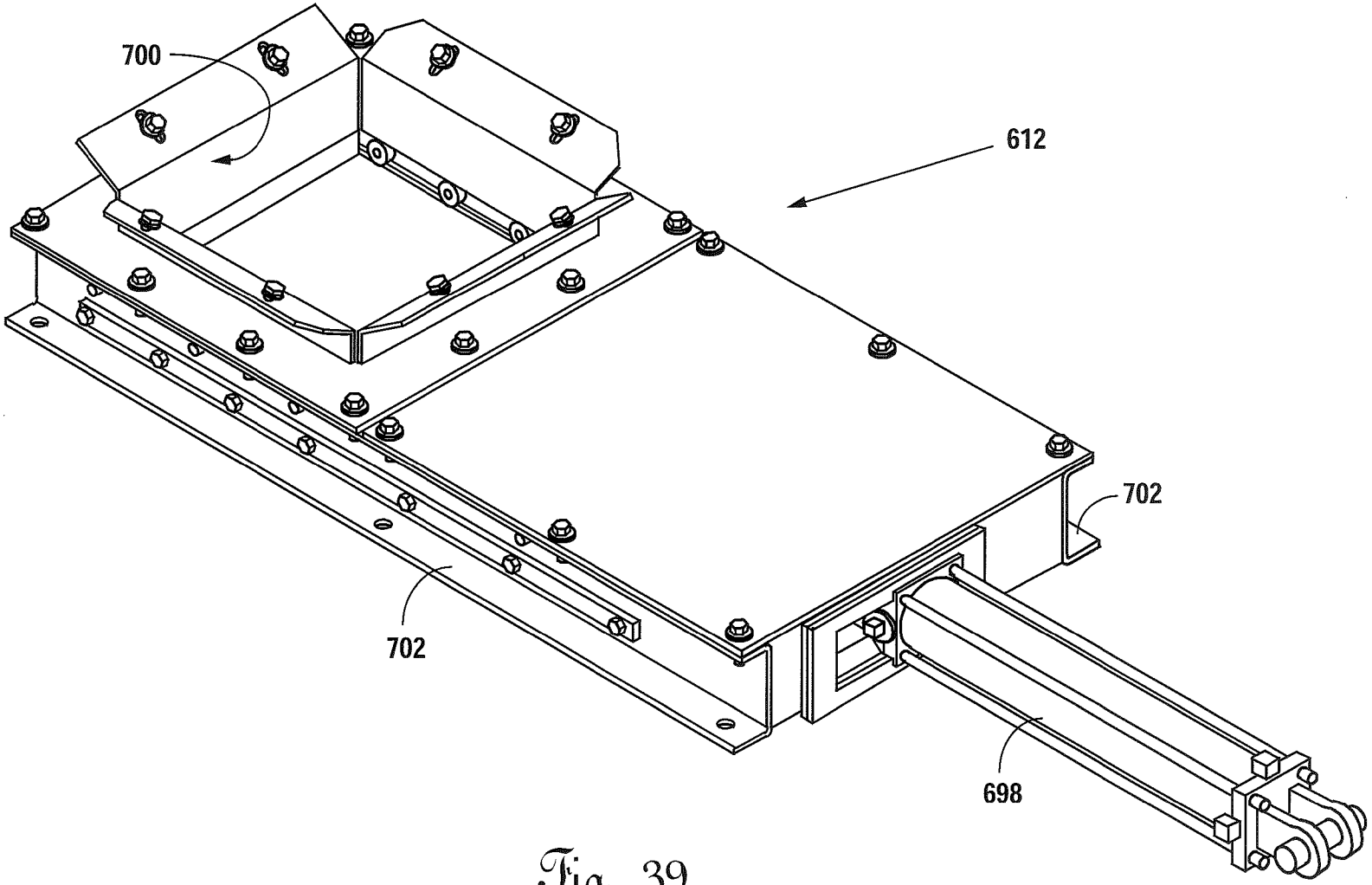
FIG. 39 is a perspective view of the sliding gate at the bottom of FIG. 33.

Referring now to FIG. 38, an alternative side view to FIG. 37 is shown. In the alternative side view of FIG. 38 is ladder 718 is provided on the side of the hopper 654 or the frame 672. Otherwise FIGS. 37 and 38 are the same.

What I claim is:

1. A method of constructing a container to carry bulk granular material from a source to an end user location using standard modes of transportation including ships, railroads or trucks, said method including the following steps:

constructing a frame having a shape similar to a cargo container, said frame having an open top and lower diagonal braces;

cutting out flat panels and bending edges of most of said flat panels to 90° with respect to said flat panels;

bolting said edges of said flat panels together to form a hopper with a lower opening therein which said hopper fits within said frame, after said bolting step, said bolted edges not interfering with gravitation flow of said bulk granular material from said hopper through said lower opening wherein during said bolting step said flat panels are located on a construction frame with lower of said flat panels being bolted together and subsequently raised to bolt together ends and sides of said flat panels to form said hopper;

inserting a sealant tape between said bolted edges of said flat panels prior to said bolting step, said sealant tape preventing said bulk granular material from leaking from said hopper;

lowering said hopper through said open top of said frame to rest on said lower diagonal braces;

securing said hopper to said frame;

attaching a lower sliding gate in said lower opening to control flow of said bulk granular material there through;

covering said hopper with a top during said bolting step, said top having at least one hatch therein for loading said hopper with said bulk granular material wherein said covering step occurs as part of said bolting step, and before said lowering step;

providing a hydraulic source to a hydraulic cylinder to open or close said lower sliding gate;

locating a ladder on a side of said frame to give access to said hatch; and removably attaching a sock below said lower opening to prevent dust when said bulk granular material is flowing there through.

2. The method of constructing a container to carry bulk granular material as recited in claim 1 wherein said flat panels are made from galvanized metal.

3. The method of constructing a container to carry bulk granular material as recited in claim 2 wherein said bolted edges are either (a) outside said hopper or (b) vertical inside such hopper so that said bolted edges do not interfere with gravitational flow of said bulk granular material.

4. The method of constructing a container to carry bulk granular material as recited in claim 3 wherein a lower outside surface of said hopper rests on said lower diagonal braces.

* * * * *